US011247474B2

(12) United States Patent
Ozaki et al.

(10) Patent No.: US 11,247,474 B2
(45) Date of Patent: Feb. 15, 2022

(54) LIQUID JETTING DEVICE, LIQUID JETTING HEAD CLEANING DEVICE, AND LIQUID JETTING HEAD CLEANING METHOD

(71) Applicant: FUJIFILM Corporation, Tokyo (JP)

(72) Inventors: Yuichi Ozaki, Kanagawa (JP); Takuma Nakano, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/824,716

(22) Filed: Mar. 20, 2020

(65) Prior Publication Data

US 2020/0215822 A1 Jul. 9, 2020

Related U.S. Application Data

(63) Continuation of application No. PCT/JP2018/034035, filed on Sep. 13, 2018.

(30) Foreign Application Priority Data

Sep. 25, 2017 (JP) ..... JP2017-183965

(51) Int. Cl.
*B41J 2/165* (2006.01)

(52) U.S. Cl.
CPC ..... *B41J 2/16552* (2013.01); *B41J 2/16588* (2013.01); *B41J 2002/16558* (2013.01)

(58) Field of Classification Search
CPC ..... B41J 2/16552; B41J 2/16588; B41J 2/16526; B41J 2/16535; B41J 2/16517; B41J 2002/16558; B41J 2002/1655
See application file for complete search history.

(56) References Cited

U.S. PATENT DOCUMENTS 4,369,456 A 1/1983 Cruz-Uribe et al.
2012/0026244 A1* 2/2012 Inoue ..... B41J 2/16585 347/33

(Continued)

FOREIGN PATENT DOCUMENTS

JP 2014000704 1/2014
JP 2014195934 10/2014

(Continued)

OTHER PUBLICATIONS

"Search Report of Europe Counterpart Application", dated Oct. 19, 2020, pp. 1-9.

(Continued)

*Primary Examiner* — Sharon Polk
(74) *Attorney, Agent, or Firm* — JCIPRNET

(57) ABSTRACT

Provided are a liquid jetting device, a liquid jetting head cleaning device, and a liquid jetting head cleaning method, in which a nozzle surface is cleaned without a liquid infiltrating into a gap of a liquid jetting head having a gap between head modules adjacent to each other.

After performing pressurization purging for pressurizing an inside of a liquid jetting head (32) that is the liquid jetting head (32), which jets a liquid from a nozzle (202) disposed on a nozzle surface (33), is formed by a plurality of head modules (200), and has a gap (G) between the head modules adjacent to each other, to discharge the liquid from the nozzle (202), a long wiping web (104) in a dry state abuts against the nozzle surface (33) of the liquid jetting head (32) at a pressing force of 0 kPa or more and 15 kPa or less, and the wiping web (104) is transported with respect to the liquid jetting head (32) in a web transporting direction to wipe the nozzle surface (33).

10 Claims, 11 Drawing Sheets

(56) References Cited

U.S. PATENT DOCUMENTS

| | | | | |
|---|---|---|---|---|
| 2012/0050394 | A1 | 3/2012 | Takada et al. | |
| 2013/0057613 | A1* | 3/2013 | Inoue | B41J 2/16535 347/33 |
| 2013/0250000 | A1* | 9/2013 | Yamamoto | B41J 2/16538 347/33 |
| 2014/0292911 | A1 | 10/2014 | Kajimoto et al. | |
| 2016/0144627 | A1 | 5/2016 | Ozaki et al. | |
| 2016/0243837 | A1 | 8/2016 | Usui | |
| 2017/0253044 | A1 | 9/2017 | Ohnishi et al. | |

FOREIGN PATENT DOCUMENTS

| | | |
|---|---|---|
| JP | 2015030236 | 2/2015 |
| JP | 2015039781 | 3/2015 |
| JP | 2015054496 | 3/2015 |
| JP | 2015134448 | 7/2015 |
| JP | 2016155240 | 9/2016 |
| JP | 2017043005 | 3/2017 |
| JP | 2017154361 | 9/2017 |

OTHER PUBLICATIONS

"International Search Report (Form PCT/ISA/210) of PCT/JP2018/034035," dated Oct. 16, 2018, with English translation thereof, pp. 1-5.

"Written Opinion of the International Searching Authority (Form PCT/ISA/237) of PCT/JP2018/034035," dated Oct. 16, 2018, with English translation thereof, pp. 1-10.

"Office Action of Japan Counterpart Application", dated Jun. 11, 2021, with English translation thereof, p. 1-p. 10.

* cited by examiner

LIQUID JETTING DEVICE, LIQUID JETTING HEAD CLEANING DEVICE, AND LIQUID JETTING HEAD CLEANING METHOD

CROSS-REFERENCE TO RELATED APPLICATIONS

The present application is a Continuation of PCT International Application No. PCT/JP2018/034035 filed on Sep. 13, 2018 claiming priority under 35 U.S.C § 119(a) to Japanese Patent Application No. 2017-183965 filed on Sep. 25, 2017. Each of the above applications is hereby expressly incorporated by reference, in its entirety, into the present application.

BACKGROUND OF THE INVENTION

1. Field of the Invention

The present invention relates to a liquid jetting device, a liquid jetting head cleaning device, and a liquid jetting head cleaning method, and particularly to a liquid jetting device, a liquid jetting head cleaning device, and a liquid jetting head cleaning method, in which a liquid jetting head having a gap between head modules adjacent to each other is cleaned.

2. Description of the Related Art

In a case where a nozzle surface of a liquid jetting head is contaminated by a residue of a liquid, there is a possibility that a jetting failure occurs in a nozzle formed on the nozzle surface in a liquid jetting device. For this reason, it is necessary to periodically clean the nozzle surface.

As a method of cleaning the nozzle surface, a method of wiping the nozzle surface by a wiping member is known. In addition, in order to wipe the nozzle surface by using an unused region of the wiping member at all times, a long wiping web is used as the wiping member, and the nozzle surface is wiped while the wiping web is being transported.

A technique in which after executing pressurization purging of forcibly jetting an ink in an ink jet head from a nozzle, a wiping web in a dry state wipes an ink jetting surface (corresponds to the nozzle surface), and then the wiping web in a wet state wipes the ink jetting surface is disclosed in JP2015-039781A.

In addition, a technique of adjusting a pressing force of a pressing member that presses an endless sheet-like wiping member (corresponds to the wiping web) against a nozzle surface is disclosed in JP2015-134448A.

A technique of adjusting an abutting force at which a maintenance member (corresponds to the wiping web) abuts against a jetting port formation surface (corresponds to a nozzle surface) is disclosed in JP2017-043005A.

SUMMARY OF THE INVENTION

A liquid jetting head configured by joining a plurality of head modules is known. Such a liquid jetting head has a gap between head modules adjacent to each other. In a case where a liquid enters this gap, a decline in the life of the head, reliability, and a printing performance and a stain on a recording medium are caused in some cases.

As in the technique disclosed in JP2015-039781A, in a case where pressurization purging is performed, a liquid on the nozzle surface, to which pressurization purging is performed, remains on the nozzle surface. There is a problem that, the liquid remaining on the nozzle surface infiltrates into the gap between the head modules in a case where the wiping web wipes the nozzle surface after then.

However, the techniques disclosed in JP2015-039781A, JP2015-134448A, and JP2017-043005A do not recognize the problem that the liquid infiltrates into the gap between the head modules in a case of wiping the nozzle surface.

The present invention is devised in view of such circumstances, and an object thereof is to provide a liquid jetting device, a liquid jetting head cleaning device, and a liquid jetting head cleaning method, in which a nozzle surface is cleaned without a liquid infiltrating into a gap of a liquid jetting head having a gap between head modules adjacent to each other.

According to an aspect of the invention, in order to achieve the object, there is provided a liquid jetting head cleaning device comprising a pressurization purging controller that performs pressurization purging for pressurizing an inside of a liquid jetting head, which jets a liquid from a nozzle disposed on a nozzle surface, is formed by a plurality of head modules, and has a gap between the head modules adjacent to each other, to discharge the liquid from the nozzle and a cleaning unit that has a first wiping mode in which a long wiping web in a dry state abuts against the nozzle surface of the liquid jetting head at a pressing force of 0 kPa or more and 15 kPa or less after the pressurization purging is performed, and the wiping web is transported with respect to the liquid jetting head in a web transporting direction to wipe the nozzle surface.

According to the aspect, since the long wiping web in the dry state abuts against the nozzle surface of the liquid jetting head at the pressing force of 0 kPa or more and 15 kPa or less after the pressurization purging is performed and the wiping web is transported with respect to the liquid jetting head in the web transporting direction to wipe the nozzle surface, the nozzle surface can be cleaned without the liquid infiltrating into the gap between the head modules.

It is preferable that the cleaning unit has a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface. Accordingly, the nozzle surface can be appropriately cleaned.

It is preferable that the cleaning unit comprises a dry wiping unit that causes the wiping web in the dry state to abut against the nozzle surface of the liquid jetting head via an abutting member at a pressing force of 0 kPa or more and 15 kPa or less, and moves the abutting member relative to the liquid jetting head to wipe the nozzle surface, a wet wiping unit that causes the wiping web in the wet state to abut against the nozzle surface of the liquid jetting head via the abutting member at a pressing force of 20 kPa or more and 60 kPa or less, and moves the abutting member relative to the liquid jetting head to wipe the nozzle surface, and a cleaning controller that causes the dry wiping unit to wipe the nozzle surface in the first wiping mode, and causes the wet wiping unit to wipe the nozzle surface in the second wiping mode. Accordingly, the nozzle surface can be cleaned without the liquid infiltrating into the gap between the head modules, and the nozzle surface can be appropriately cleaned.

It is preferable that the cleaning unit comprises a wiping unit that causes the wiping web to abut against the nozzle surface of the liquid jetting head via an abutting member, and moves the abutting member relative to the liquid jetting head to wipe the nozzle surface, a pressing force adjusting unit that adjusts a pressing force between the nozzle surface and the wiping web, a cleaning liquid applying unit that applies the cleaning liquid to the wiping web in the dry state to bring the wiping web into the wet state, and a cleaning controller that causes the cleaning liquid applying unit not to operate and causes the wiping web in the dry state to abut against the nozzle surface at a pressing force of 0 kPa or more and 15 kPa or less in the first wiping mode, and causes the cleaning liquid applying unit to apply the cleaning liquid and causes the wiping web in the wet state to abut against the nozzle surface at a pressing force of 20 kPa or more and 60 kPa or less in the second wiping mode. Accordingly, the nozzle surface can be cleaned without the liquid infiltrating into the gap between the head modules, and the nozzle surface can be appropriately cleaned.

It is preferable that the cleaning unit comprises an elastic member that causes the abutting member to be biased in a first direction facing the nozzle surface and a supporting unit that supports the elastic member. It is preferable that the cleaning controller sets a distance between the supporting unit and the nozzle surface in the first direction to a first distance at which the pressing force between the nozzle surface and the wiping web is a pressing force of 0 kPa or more and 15 kPa or less in the first wiping mode, and sets the distance between the supporting unit and the nozzle surface in the first direction to a second distance at which the pressing force between the nozzle surface and the wiping web is a pressing force of 20 kPa or more and 60 kPa or less in the second wiping mode. Accordingly, the pressing force can be appropriately set.

It is preferable that the cleaning unit has a third wiping mode in which the long wiping web that is in the wet state due to the cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface. It is preferable that the cleaning unit performs wiping in the second wiping mode after wiping in the first wiping mode, and performs wiping in the third wiping mode after wiping in the second wiping mode. Accordingly, the nozzle surface can be appropriately cleaned.

According to another aspect of the invention, in order to achieve the object, there is provided a liquid jetting head cleaning device comprising a cleaning unit that has a first wiping mode in which a long wiping web in a dry state abuts against a nozzle surface of a liquid jetting head, which jets a liquid from a nozzle disposed on the nozzle surface, is formed by a plurality of head modules, and has a gap between the head modules adjacent to each other, at a pressing force of 0 kPa or more and 15 kPa or less and the wiping web is transported with respect to the liquid jetting head in a web transporting direction to wipe the nozzle surface and a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface and a selecting unit that selects one mode of the first wiping mode and the second wiping mode.

According to the aspect, since one mode is selected of the first wiping mode in which the long wiping web in the dry state abuts at the pressing force of 0 kPa or more and 15 kPa or less and the second wiping mode in which the long wiping web in the wet state due to the cleaning liquid abuts at the pressing force of 20 kPa or more and 60 kPa or less, the nozzle surface can be appropriately cleaned.

According to another aspect of the invention, in order to achieve the object, there is provided a liquid jetting device comprising a liquid jetting head that jets a liquid from a nozzle disposed on a nozzle surface, is formed by a plurality of head modules, and has a gap between the head modules adjacent to each other, a transporting unit that transports a recording medium, a recording controller that causes the liquid to be jetted from the nozzle of the liquid jetting head to the transported recording medium to record an image on the recording medium, a pressurization purging controller that performs pressurization purging for pressurizing an inside of the liquid jetting head to discharge the liquid from the nozzle, and a cleaning unit that has a first wiping mode in which a long wiping web in a dry state abuts against the nozzle surface of the liquid jetting head at a pressing force of 0 kPa or more and 15 kPa or less after the pressurization purging is performed, and the wiping web is transported with respect to the liquid jetting head in a web transporting direction to wipe the nozzle surface.

According to the aspect, since the long wiping web in the dry state abuts against the nozzle surface of the liquid jetting head at the pressing force of 0 kPa or more and 15 kPa or less after the pressurization purging is performed and the wiping web is transported with respect to the liquid jetting head in the web transporting direction to wipe the nozzle surface, the nozzle surface can be cleaned without the liquid infiltrating into the gap between the head modules.

It is preferable that a plurality of the liquid jetting heads that jet inks having colors different from each other are provided. It is preferable that in the first wiping mode, the cleaning unit sets a pressing force in a case of wiping the liquid jetting head that jets a black ink to a pressing force smaller than a pressing force in a case of wiping the liquid jetting head that jets an ink other than the black ink. Accordingly, the life of the nozzle surface of the liquid jetting head that jets the black ink can be prolonged.

According to another aspect of the invention, in order to achieve the object, there is provided a liquid jetting head cleaning method comprising a pressurization purging step of performing pressurization purging for pressurizing an inside of a liquid jetting head, which jets a liquid from a nozzle disposed on a nozzle surface, is formed by a plurality of head modules, and has a gap between the head modules adjacent to each other, to discharge the liquid from the nozzle and a cleaning step of causing a long wiping web in a dry state to abut against the nozzle surface of the liquid jetting head at a pressing force of 0 kPa or more and 15 kPa or less after the pressurization purging is performed, and wiping the nozzle surface by transporting the wiping web with respect to the liquid jetting head in a web transporting direction.

According to the aspect, since the long wiping web in the dry state abuts against the nozzle surface of the liquid jetting head at the pressing force of 0 kPa or more and 15 kPa or less after the pressurization purging is performed and the wiping web is transported with respect to the liquid jetting head in the web transporting direction to wipe the nozzle surface, the nozzle surface can be cleaned without the liquid infiltrating into the gap between the head modules.

According to still another aspect of the invention, in order to achieve the object, there is provided a liquid jetting head cleaning method comprising a cleaning step that has a first wiping mode in which a long wiping web in a dry state abuts against a nozzle surface of a liquid jetting head, which jets a liquid from a nozzle disposed on the nozzle surface, is formed by a plurality of head modules, and has a gap between the head modules adjacent to each other, at a pressing force of 0 kPa or more and 15 kPa or less and the wiping web is transported with respect to the liquid jetting head in a web transporting direction to wipe the nozzle surface and a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface and a selecting step of selecting one mode of the first wiping mode and the second wiping mode.

According to the aspect, since one mode is selected of the first wiping mode in which the long wiping web in the dry state abuts at the pressing force of 0 kPa or more and 15 kPa or less and the second wiping mode in which the long wiping web in the wet state due to the cleaning liquid abuts at the pressing force of 20 kPa or more and 60 kPa or less, the nozzle surface can be appropriately cleaned.

In the present invention, the nozzle surface can be cleaned without the liquid infiltrating into the gap between the head modules.

DESCRIPTION OF THE PREFERRED EMBODIMENTS

Hereinafter, a preferable embodiment of the invention will be described in detail with reference to accompanying drawings.

<Ink Jet Recording Device>

Figure 1:
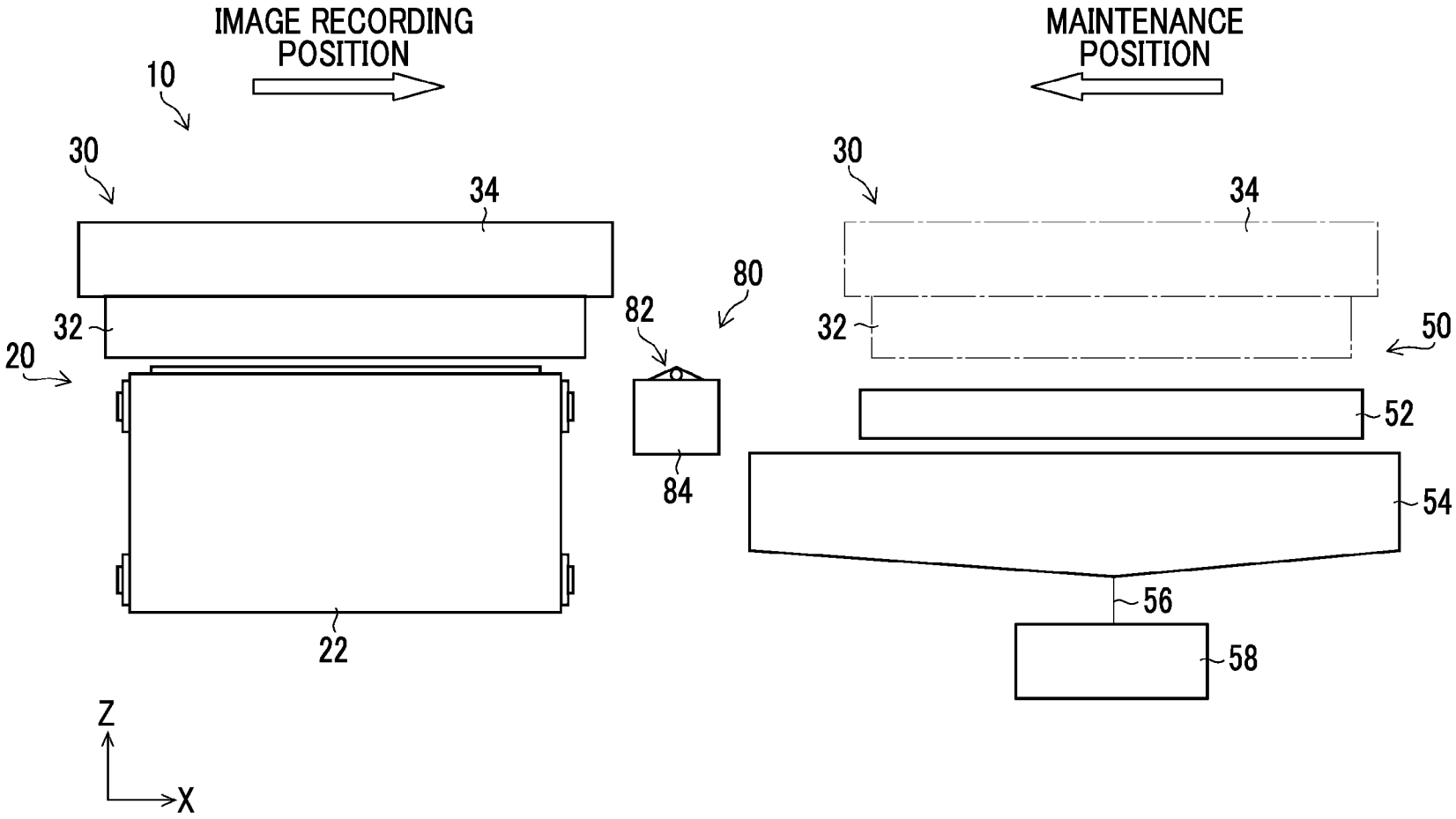
FIG. 1 is a front view of an ink jet recording device.
Figure 2:
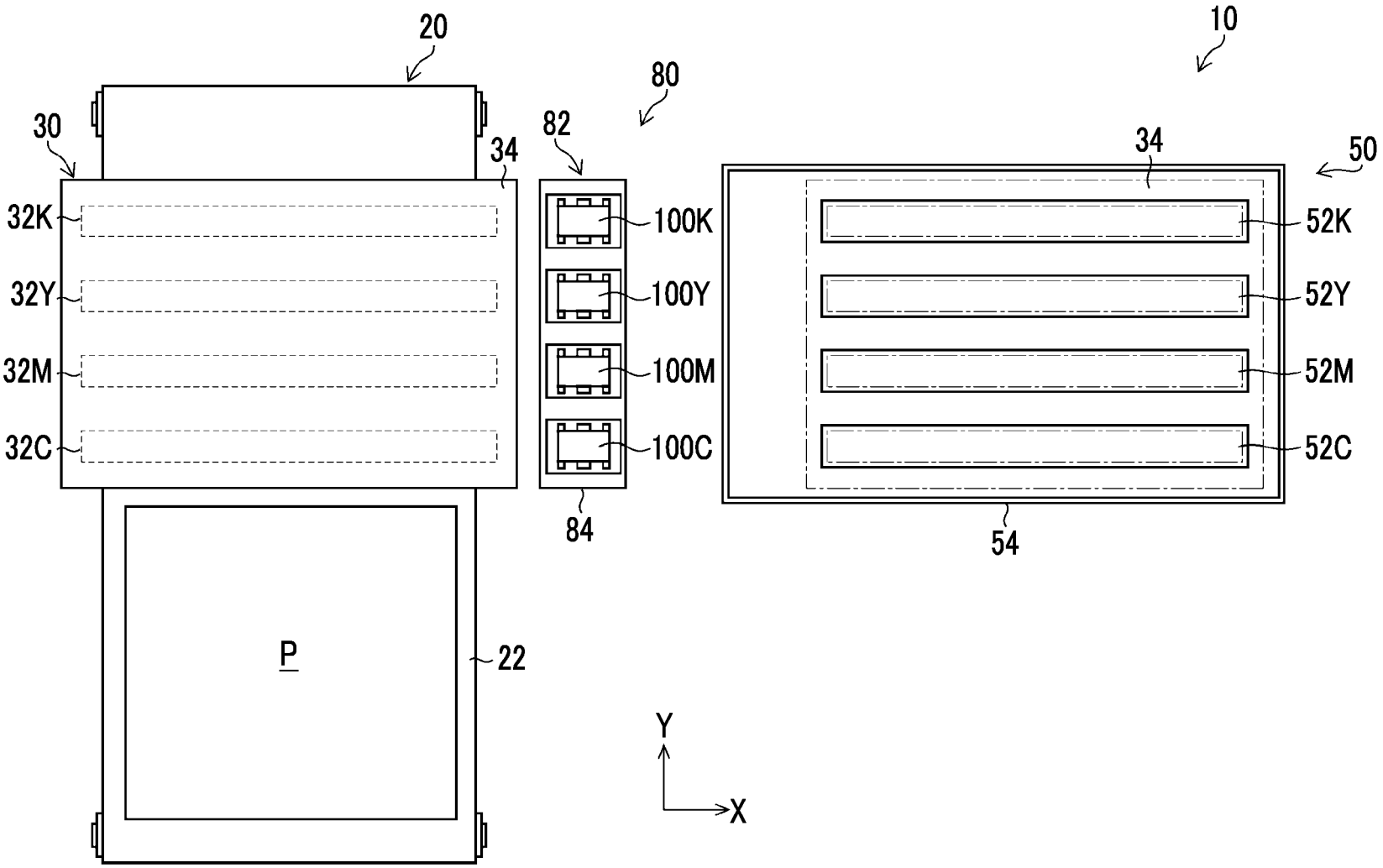
FIG. 2 is a plan view of the ink jet recording device.
Figure 3:
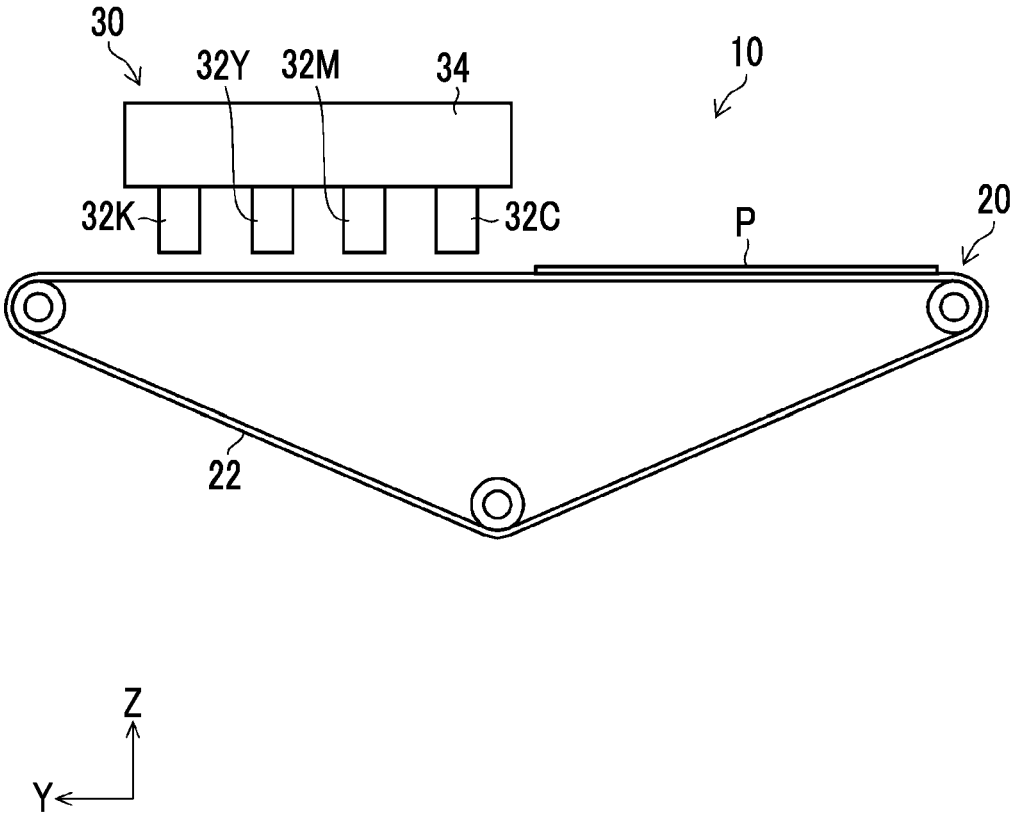
FIG. 3 is a side view of the ink jet recording device.

FIGS. 1 to 3 are a front view, a plan view, and a side view, each of which illustrates important parts of an ink jet recording device 10 according to the embodiment.

The ink jet recording device 10 (an example of a liquid jetting device and an example of a liquid jetting head cleaning device) is a single-pass system line printer, and is configured to mainly comprise a sheet transporting unit 20 that transports a sheet P, which is a recording medium, a head unit 30 that comprises a plurality of ink jet heads 32C, 32M, 32Y, and 32K, a head moving unit 36 (refer to FIG. 8) that moves the head unit 30, a maintenance unit 50 that maintains the ink jet heads 32C, 32M, 32Y, and 32K, and a nozzle surface cleaning unit 80 that wipes and cleans nozzle surfaces of the ink jet heads 32C, 32M, 32Y, and 32K included in the head unit 30.

The sheet transporting unit 20 causes a running belt 22 to adsorb the sheet P, thereby transporting the sheet P. A running route is set such that the belt 22 runs horizontally at some places. The sheet transporting unit 20 horizontally transports the sheet P by using places where the belt 22 runs horizontally. The sheet P is transported in a Y-direction in a horizontal posture by the sheet transporting unit 20.

The ink jet heads 32C, 32M, 32Y, and 32K jet cyan ink droplets, magenta ink droplets, yellow ink droplets, and black ink droplets, respectively. The ink jet heads 32C, 32M, 32Y, and 32K are mounted onto a head supporting frame 34.

The ink jet heads 32C, 32M, 32Y, and 32K each have a rectangular block shape, and each are a full line type ink jet head corresponding to a maximum sheet width of the sheet P, which is a printing target.

The head supporting frame 34 is attachably and detachably mounted onto a head mounting unit (not illustrated) for mounting each head 32.

In a case where each head 32 is mounted onto the head supporting frame 34, nozzle surfaces 33 (refer to FIG. 4) are disposed to be parallel to an XY-plane, which is a horizontal plane, and are disposed to be orthogonal to the Y-direction, which is a transporting direction of the sheet P, with a fixed interval along the Y-direction.

In addition, the head mounting unit is provided such that a position thereof in a Z-direction, which is a vertical direction, is adjustable. Height positions of the nozzle surface 33 of each head 32 mounted on the head mounting unit are adjusted by adjusting the position of the head mounting unit in the Z-direction.

The head moving unit 36 (refer to FIG. 8) horizontally moves the head unit 30 in an X-direction orthogonal to the Y-direction. For example, the head moving unit 36 is configured by a ceiling frame horizontally provided so as to straddle the sheet transporting unit 20, a guide rail laid on the ceiling frame, a running body that slidingly moves on the guide rail, and driving means that moves the running body along the guide rail. As the driving means, for example, a feed screw mechanism formed of a feed screw and a motor that rotation-drives the feed screw can be used. The head supporting frame 34 is mounted onto the running body, and the head unit 30 moves horizontally and slidingly.

The ink jet heads 32C, 32M, 32Y, and 32K included in the head unit 30 move between an "image recording position" and a "maintenance position" by the head unit 30 being driven by the head moving unit 36 to move horizontally.

At the image recording position, the ink jet heads 32C, 32M, 32Y, and 32K face the sheet P transported by the sheet transporting unit 20. The sheet P is horizontally transported along one direction by the sheet transporting unit 20. In a case where the sheet P passes below the head unit 30 in the Z-direction, ink droplets are jetted to the sheet P from each of the ink jet heads 32C, 32M, 32Y, and 32K included in the head unit 30. Accordingly, an image is recorded onto the sheet P.

At the maintenance position, the ink jet heads 32C, 32M, 32Y, and 32K face the maintenance unit 50. The maintenance unit 50 stores a moisturizing liquid, and comprises caps 52C, 52M, 52Y, and 52K that cover the nozzle surfaces 33 of the ink jet heads 32C, 32M, 32Y, and 32K respectively. Configurations of the caps 52C, 52M, 52Y, and 52K are the same.

In a case where the ink jet heads 32C, 32M, 32Y, and 32K are positioned at the maintenance position, the ink jet heads are positioned above the caps 52C, 52M, 52Y, and 52K in the Z-direction respectively. At the maintenance position, a maintenance operation of the ink jet heads 32C, 32M, 32Y, and 32K is performed by a maintenance controller 160 (refer to FIG. 8). Examples of the maintenance operation include pre-jetting of driving a piezoelectric element provided for each of nozzles 202 (refer to FIG. 6) and jetting an ink that does not contribute to recording from the plurality of nozzles 202 and pressurization purging of pressurizing the inside of the head 32 and discharging the ink from the plurality of nozzles 202.

The caps 52C, 52M, 52Y, and 52K each comprise a suction mechanism (not illustrated) for sucking the nozzles 202 and a moisturizing liquid supplying mechanism (not illustrated) for supplying a moisturizing liquid to the caps 52C, 52M, 52Y, and 52K. In addition, a waste liquid tray 54 is disposed below the caps 52C, 52M, 52Y, and 52K in the Z-direction. A moisturizing liquid supplied to the cap 52 is discarded to the waste liquid tray 54, and is collected to a waste liquid tank 58 from the waste liquid tray 54 via waste liquid collecting piping 56.

In a case where the device is stopped for a long period of time, the head unit 30 is moved to the maintenance position, the nozzle surfaces 33 of the ink jet heads 32C, 32M, 32Y, and 32K are covered with the caps 52C, 52M, 52Y, and 52K respectively, and a moisturization space is formed between the nozzle surfaces 33 and the caps 52C, 52M, 52Y, and 52K. Accordingly, non-jetting caused by dryness is prevented.

The nozzle surface cleaning unit 80 is provided between the image recording position and the maintenance position on a moving route of the head unit 30. The nozzle surface cleaning unit 80 comprises a nozzle surface wiping unit 82 that wipes the nozzle surfaces 33 of the ink jet heads 32C, 32M, 32Y, and 32K.

In a case where the ink jet heads 32C, 32M, 32Y, and 32K move between the image recording position and the maintenance position, the nozzle surface wiping unit 82 (an example of a cleaning unit) wipes each of the nozzle surfaces 33.

The nozzle surface wiping unit 82 comprises nozzle surface wiping devices 100C, 100M, 100Y, and 100K that individually wipe the nozzle surfaces 33 of the ink jet heads 32C, 32M, 32Y, and 32K included in the head unit 30. Each of the nozzle surface wiping devices 100C, 100M, 100Y, and 100K is provided on a common stand 84 in accordance with provision intervals between the ink jet heads 32C, 32M, 32Y, and 32K.

The nozzle surface wiping unit 82 is configured to be movable between a wiping position where each of the nozzle surfaces 33 is wiped and a retracted position where each of the nozzle surfaces 33 is not wiped in a case where the ink jet heads 32C, 32M, 32Y, and 32K are moved to a position of facing the nozzle surface wiping unit 82 by a moving mechanism (not illustrated).

<Structure of Ink Jet Head>

Since structures of the ink jet heads 32C, 32M, 32Y, and 32K are the same, the ink jet heads will be described as the heads 32 in the following except for a case of particularly differentiating between the ink jet heads.

Figure 4:
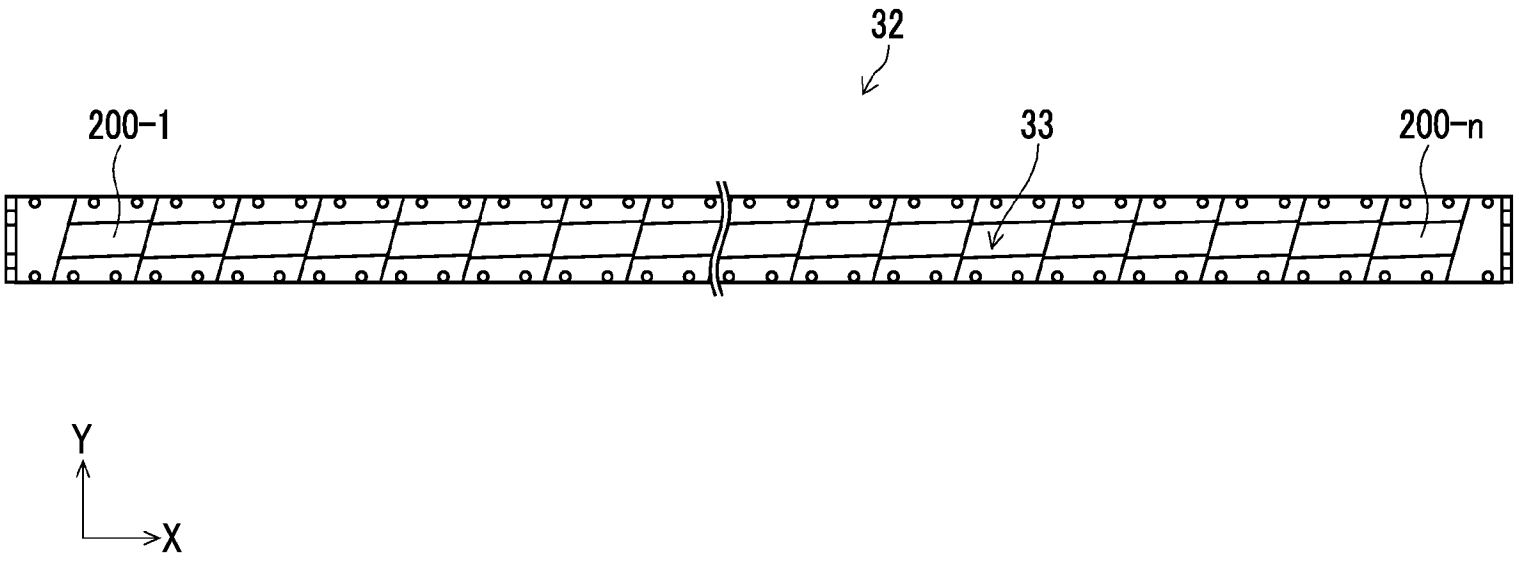
FIG. 4 is a configuration view of a head.

FIG. 4 is a configuration view of the head 32. The head 32 has a structure where head modules 200-1 to **200-*n* are joined together in a width direction (the X-direction) of the sheet P orthogonal to the transporting direction (the Y-direction) of the sheet P. Configurations of the head modules 200-1 to 200-*n*** are the same.

Figure 5:
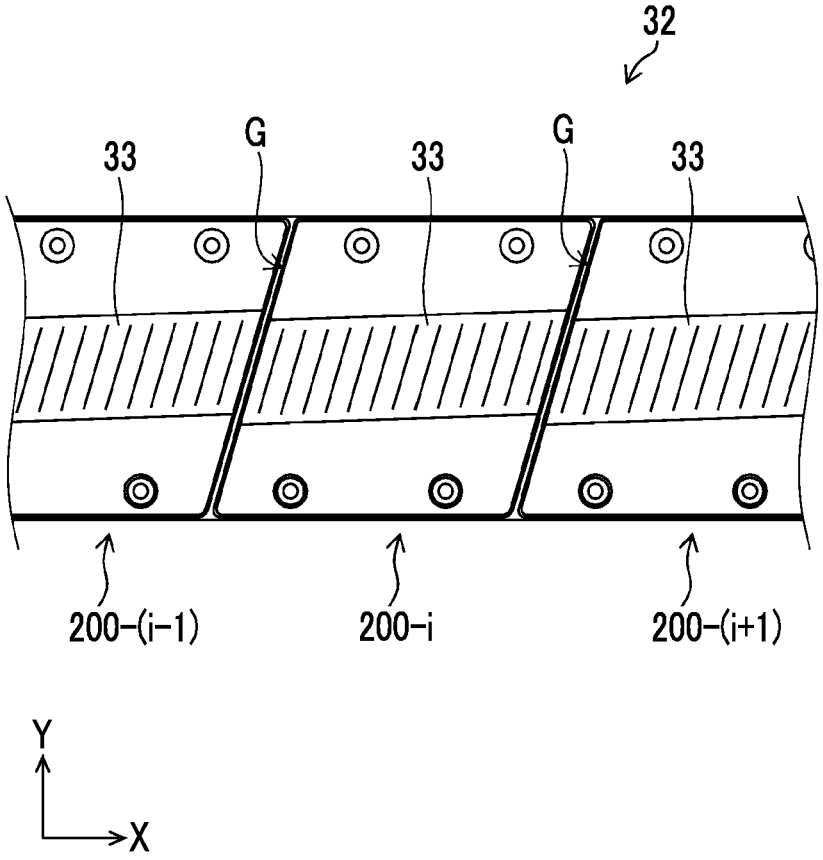
FIG. 5 is a partially enlarged view of FIG. 4.

FIG. 5 is a partially enlarged view of FIG. 4. FIG. 5 illustrates a head module **200-*i*, a head module 200-(*i*−1) adjacent to the head module 200-*i* to the left in FIG. 4, and a head module 200-(*i*+1) adjacent to the head module 200-*i* to the right in FIG. 4. As illustrated in FIG. 5, there is a gap G between the head module 200-*i* and the head module 200-(*i*−1) (an example in which there is a gap between the head modules). Similarly, there is the gap G also between the head module 200-*i* and the head module 200-(*i*+1). As described above, the heads 32 have the gaps G between the head modules 200** adjacent to each other.

Figure 6:
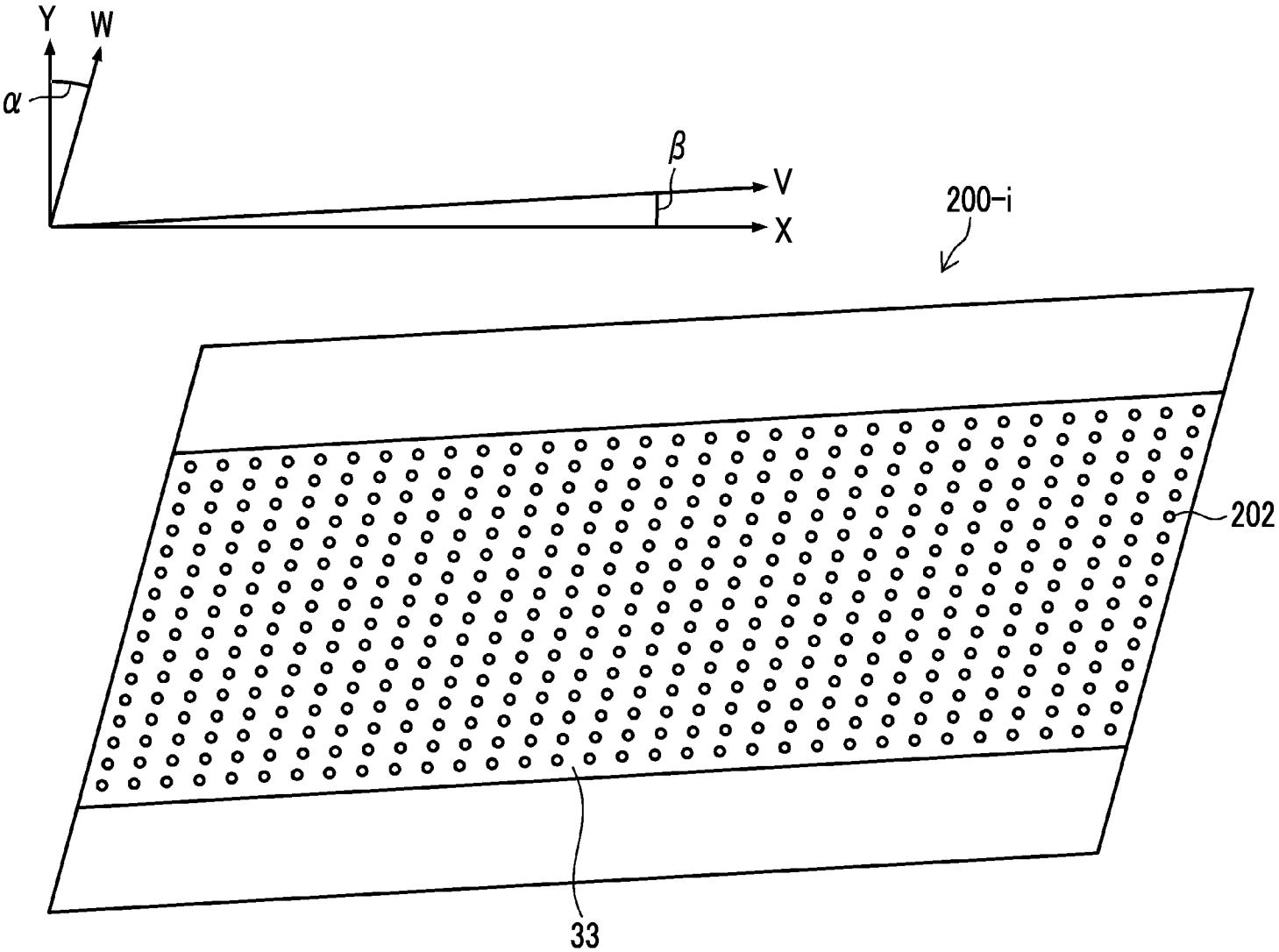
FIG. 6 is a plan view of a head module.

FIG. 6 is a plan view of the head module **200-*i*. As illustrated in FIG. 6, the plurality of nozzles 202 are disposed on the nozzle surface 33 of the head module 200-*i*. Accordingly, the heads 32 configure the full line type ink jet head in which the plurality of nozzles 202** are arranged in a matrix over a length corresponding to a full length of the recording medium, which is transported in the Y-direction, in the X-direction.

The head module **200-*i* has a parallelogrammic planar shape formed of long-side end surfaces along a V-direction, each of which has an inclination of an angle 3 with respect to the X-direction, and short-side end surfaces along a W-direction, each of which has an inclination of an angle $\alpha$ with respect to the Y-direction. The plurality of nozzles 202 are disposed along a row direction which follows the V-direction and a column direction which follows the W-direction on each of the nozzle surfaces 33. The disposition of the nozzles 202 is not limited to a form illustrated in FIG. 6, and the plurality of nozzles 202** may be disposed along a row direction which follows the X-direction and a column direction which obliquely intersects the X-direction.

In the head module **200-*i* in which the nozzles 202 are disposed in a matrix, the nozzles 202 are disposed at equal intervals in the X-direction, in a projected nozzle column in which the nozzles 202 are projected so as to be arranged in the X-direction. That is, the X-direction is the actual disposition direction of the nozzles, and an interval between the nozzles 202 of the projected nozzle column in the X-direction is recording resolution of the head 32** in the X-direction.

Although illustration thereof is omitted, the head module **200-*i* comprises a supply flow passage that communicates with a pressure chamber via the pressure chamber and a supply port that communicate with the nozzles 202. In a case where an ink (an example of a liquid) is jetted from the nozzles 202**, and the ink fills the pressure chamber via the supply port from the supply flow passage.

A piezoelectric system in which deflection deformation of the piezoelectric element is used may be applied to an ink jetting system of each head 32, and a thermal system in which an ink film boiling phenomenon is used may be applied to the ink jetting system of each head 32. In a case where a drive voltage is applied to the piezoelectric element in the piezoelectric system, a volume of the pressure chamber decreases according to deflection deformation of the piezoelectric element, and an ink corresponding to a decrease in the volume of pressure chamber is jetted from the nozzles 202.

In addition, in the thermal system, an ink in the pressure chamber is heated to generate bubbles, and an ink corresponding to a decrease in the volume of pressure chamber is jetted from the nozzles 202.

A liquid repellent film having liquid repellency with respect to an ink and a cleaning liquid to be described below is formed on each of the nozzle surfaces 33, and the entire nozzle surfaces 33 have liquid repellency. A contact angle between the nozzle surface 33 and the ink and a contact angle between the nozzle surface 33 and the cleaning liquid are both 90° or larger. The entire nozzle surfaces 33 are not limited to having liquid repellency, and only a necessary region of each nozzle surface 33 in the vicinity of the nozzles 202 may have liquid repellency.

<Nozzle Surface Cleaning Unit>

Since configurations of the nozzle surface wiping devices 100C, 100M, 100Y, and 100K are the same, the nozzle surface wiping devices will be described as the nozzle surface wiping device 100 in the following except for a case of particularly differentiating between the nozzle surface wiping devices.

Figure 7:
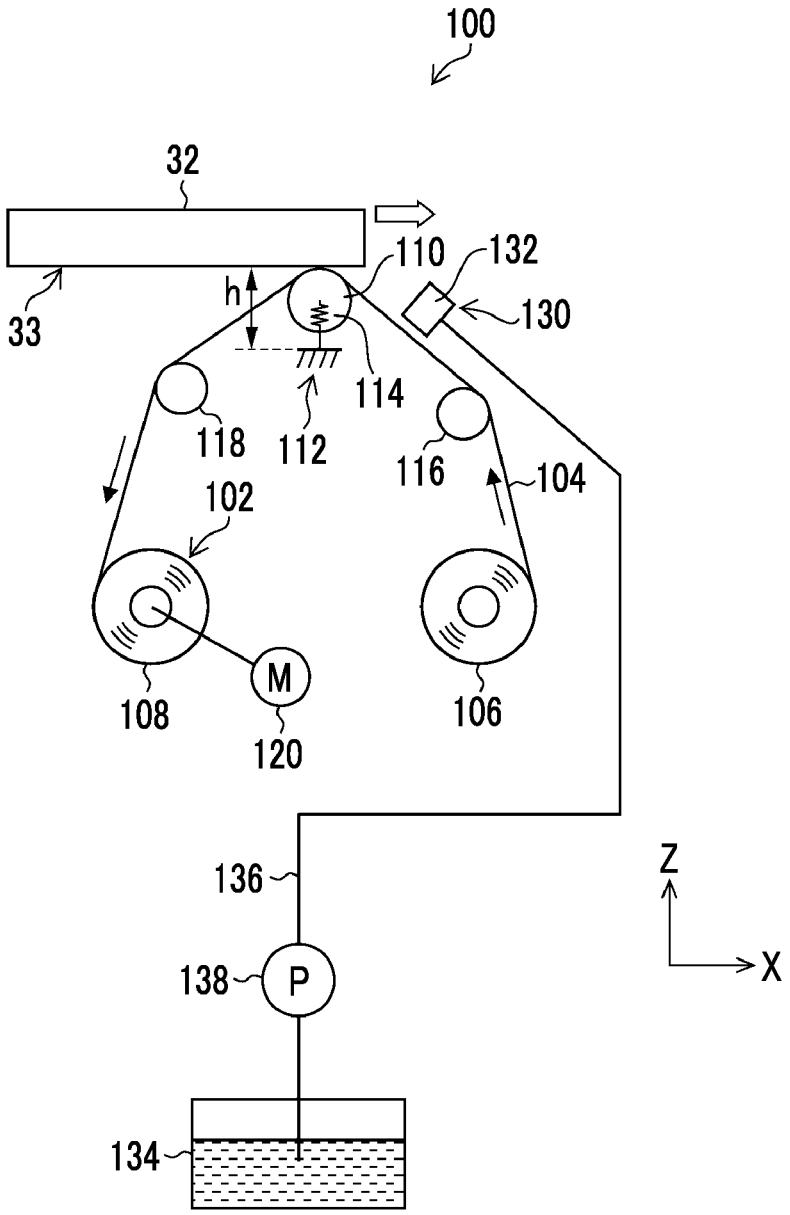
FIG. 7 is a schematic view of a nozzle surface wiping device.

FIG. 7 is a schematic view illustrating a schematic configuration of the nozzle surface wiping device 100. As illustrated in FIG. 7, the nozzle surface wiping device 100 comprises a web transporting unit 102 that transports a wiping web 104 in a web transporting direction and a cleaning liquid applying unit 130 that supplies a cleaning liquid to the wiping web 104.

[Configuration of Web Transporting Unit]

The web transporting unit 102 comprises a supply shaft 106 that sends out the wiping web 104, a winding shaft 108 that winds the wiping web 104, a press roller 110 that presses the wiping web 104 so as to abut against the nozzle surface 33 of the head 32, a supporting stand 112 that supports the press roller 110, a spring 114 that causes the press roller 110 to be biased upward (the direction of the nozzle surface 33, which is an example of a first direction) in the Z-direction, a first guide roller 116 that guides running of the wiping web 104 between the supply shaft 106 and the press roller 110, a second guide roller 118 that guides running of the wiping web 104 between the press roller 110 and the winding shaft 108, and a winding motor 120 that rotation-drives the winding shaft 108.

The wiping web 104 is configured of a long sheet material that is formed by knit or textile in which microfiber, such as polyethylene terephthalate, polyethylene, and acryl, is used and has absorbability. A width of the wiping web 104 corresponds to a width of the nozzle surface 33 of the head 32, which is a wiping target, in a lateral direction, that is, a width in a direction orthogonal to a moving direction of the head 32, and is a width that is the same or substantially the same as a width of the nozzle surface.

The supply shaft 106 is rotatably supported by a shaft (not illustrated). The supply shaft 106 is disposed to be orthogonal to the moving direction of the head 32, and is disposed horizontally. A reel (not illustrated) is attachably and detachably mounted on the supply shaft 106. The wiping web 104 is wound around the reel in a roll shape, and is mounted on the supply shaft 106.

The wiping web 104 mounted on the supply shaft 106 is in a dry state (cleaning liquid non-applied state) where a cleaning liquid is not applied.

The winding shaft 108 is rotatably supported by a shaft (not illustrated). The winding shaft 108 is disposed to be orthogonal to the moving direction of the head 32, and is disposed horizontally. A reel (not illustrated) is attachably and detachably mounted on the winding shaft 108. The wiping web 104 is wound around the reel mounted on the winding shaft 108 in a roll shape.

The press roller 110 (an example of an abutting member) has a roller shape (cylindrical shape). A length of the press roller 110 in a direction (axial direction) orthogonal to a radial direction thereof is a length corresponding to the width of the wiping web 104, and a size thereof in the radial direction can be determined as appropriate. The press roller 110 is supported to be rotatable and movable up and down in a state of being biased upward in the Z-direction by the spring 114.

The press roller 110 is disposed to be orthogonal to the moving direction of the head 32, and is disposed horizontally. The wiping web 104 is wound around an upper circumferential surface of the press roller 110, and is pressed and abutted against the nozzle surface 33 of the head 32 via the press roller 110.

The supporting stand 112 (an example of a supporting unit) is connected to one end of the spring 114 (an example of an elastic member). In addition, the press roller 110 is connected to the other end of the spring 114. Accordingly, the supporting stand 112 supports the press roller 110 via the spring 114. In addition, the spring 114 causes the press roller 110 to be biased upward in the Z-direction.

The head 32 that is moved to a position facing the press roller 110 by the head moving unit 36 is configured such that a height thereof in the Z-direction in a case of moving is changeable. Accordingly, a distance h between the supporting stand 112 and the nozzle surface 33 can be changed, and a pressing force between the wiping web 104 and the nozzle surface 33 is adjustable. Data related to a relationship between the distance h and the pressing force is acquired in advance, and is stored in a memory (not illustrated).

The first guide roller 116 is rotatably supported by a horizontal shaft (not illustrated), and is disposed between the supply shaft 106 and the press roller 110 so as to be orthogonal to the moving direction of the head 32. The first guide roller 116 guides the wiping web 104 sent out from the supply shaft 106 to the press roller 110.

The second guide roller 118 is rotatably supported by a horizontal shaft (not illustrated), and is disposed between the press roller 110 and the winding shaft 108 so as to be orthogonal to the moving direction of the head 32. The second guide roller 118 guides the wiping web 104, which has wiped the nozzle surface 33 by means of the press roller 110, to the winding shaft 108.

The winding motor 120 has a rotary shaft (not illustrated) connected to the winding shaft 108, and rotation-drives the winding shaft 108 by rotating the rotary shaft. As the winding shaft 108 rotates to the left in FIG. 7, the wiping web 104 is transported from the supply shaft 106 to the winding shaft 108, and the winding shaft 108 is wound.

[Configuration of Cleaning Liquid Applying Unit]

Control by a cleaning controller 154 (refer to FIG. 8) causes the cleaning liquid applying unit 130 to bring the wiping web 104 that abuts against the nozzle surface 33 into a wet state (cleaning liquid applied state).

The cleaning liquid applying unit 130 is configured to comprise a cleaning liquid supplying nozzle 132, a cleaning liquid tank 134 that stores a cleaning liquid, a cleaning liquid flow passage 136 that connects the cleaning liquid supplying nozzle 132 to the cleaning liquid tank 134, and a cleaning liquid pump 138 that sends a cleaning liquid from the cleaning liquid tank 134 to the cleaning liquid supplying nozzle 132.

By driving the cleaning liquid pump 138, the cleaning liquid applying unit 130 supplies a cleaning liquid from the cleaning liquid tank 134 to the cleaning liquid supplying nozzle 132 via the cleaning liquid flow passage 136.

The cleaning liquid supplying nozzle 132 has a spouting port having a width corresponding to the width of the wiping web 104, and spouts the cleaning liquid, which is supplied from the cleaning liquid tank 134, from the spouting port to the wiping web 104. In a case where the wiping web 104 passes a position facing the cleaning liquid supplying nozzle 132, the cleaning liquid spouted from the spouting port is applied to the wiping web. Accordingly, the cleaning liquid is absorbed into the wiping web 104, and the wiping web 104 comes into the wet state.

A transported speed of the wiping web 104 by the web transporting unit 102 and an applied amount of a cleaning liquid supplied by the cleaning liquid applying unit 130 are determined by a cleaning liquid permeation speed of the wiping web 104. That is, it is necessary to set time it takes for the wiping web 104 to be transported from the position facing the cleaning liquid supplying nozzle 132 to a position of the press roller 110 longer than time it takes for the cleaning liquid supplied to the wiping web 104 to permeate the wiping web 104.

The nozzle surface wiping device 100 configured in such a manner has a dry wiping mode (an example of a first wiping mode) in which the wiping web 104 in the dry state wipes the nozzle surface 33 and a wet wiping mode (an example of a second wiping mode) in which the wiping web 104 in the wet state wipes the nozzle surface 33.

As the cleaning liquid applying unit 130 stops applying a cleaning liquid in the dry wiping mode, the wiping web 104 that abuts against the nozzle surface 33 is brought into the dry state (cleaning liquid non-applied state). In addition, in the wet wiping mode, the cleaning liquid applying unit 130 brings the wiping web 104 that abuts against the nozzle surface 33 into the wet state (cleaning liquid applied state).

<Control System of Ink Jet Recording Device>

Figure 8:
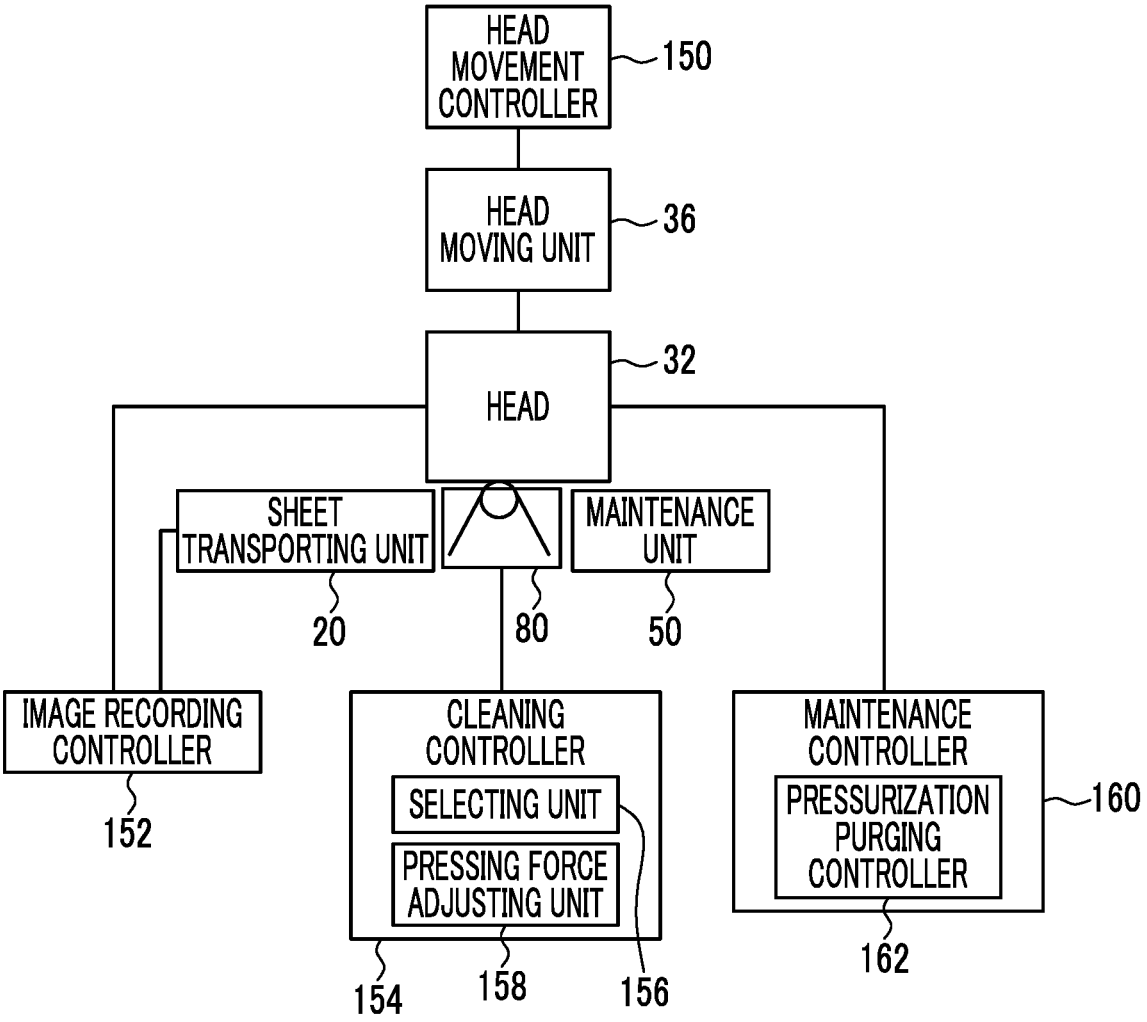
FIG. 8 is a block diagram showing a control system of the ink jet recording device.

FIG. 8 is a block diagram showing a control system of the ink jet recording device 10. The ink jet recording device 10 comprises a head movement controller 150, an image recording controller 152, the cleaning controller 154, and the maintenance controller 160.

The head movement controller 150 controls the head moving unit 36, and moves the head 32 included in the head unit 30 between the "image recording position" and the "maintenance position".

The image recording controller 152 controls the sheet transporting unit 20 and a piezoelectric element (not illustrated) for each of the nozzles 202 of the head 32 positioned at the image recording position based on image data to be recorded onto the sheet P to transport the sheet P and to jet ink droplets of each color, and records an image on a recording surface of the sheet P.

The cleaning controller 154 controls the nozzle surface wiping unit 82 to wipe the nozzle surface 33 of the head 32 (refer to FIG. 4). The cleaning controller 154 comprises a selecting unit 156 and a pressing force adjusting unit 158.

The selecting unit 156 selects the dry wiping mode or the wet wiping mode.

The pressing force adjusting unit 158 adjusts a pressing force between the wiping web 104 and the nozzle surface 33 according to a mode selected by the selecting unit 156. The pressing force is adjusted by changing the distance h between the supporting stand 112 and the nozzle surface 33. Although the distance h is changed by adjusting a position of the supporting stand 112 in the Z-direction herein, the distance h may be changed by adjusting a position of the head 32 in the Z-direction.

The maintenance controller 160 performs supply of a moisturizing liquid to the caps 52C, 52M, 52Y, and 52K. In addition, the maintenance controller controls the suction mechanism (not illustrated) and the moisturizing liquid supplying mechanism (not illustrated).

In addition, the maintenance controller 160 (an example of a pre-jetting controller) causes an ink to be pre-jetted from the nozzles 202 of the head 32.

The maintenance controller 160 comprises a pressurization purging controller 162. The pressurization purging controller 162 causes a pressurizing unit (not illustrated) to pressurize the inside of the head 32, and causes an ink to be discharged from the nozzles 202 of the head 32.

<Liquid Jetting Head Cleaning Method>

Figure 9:
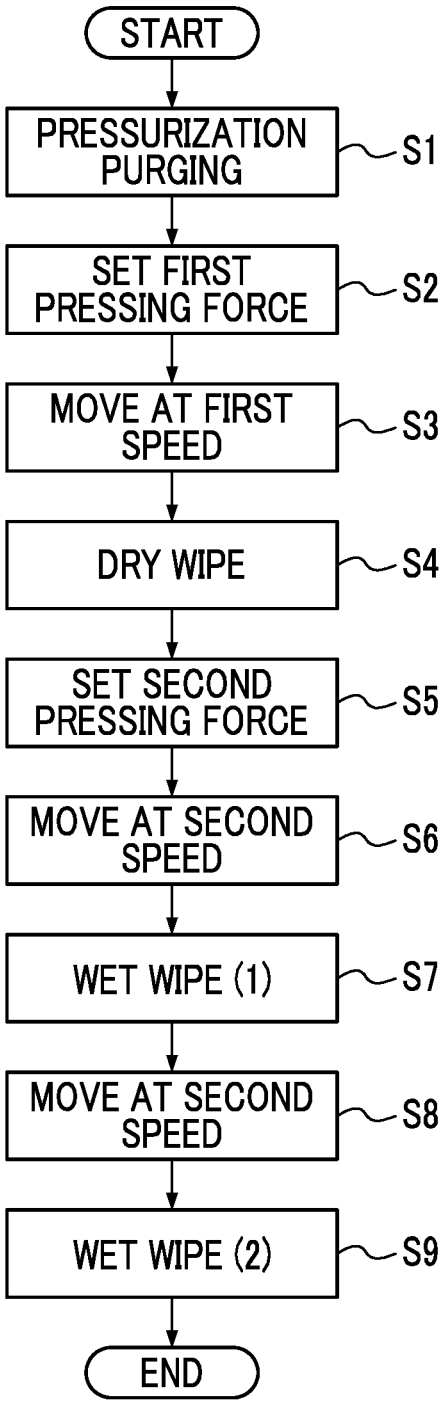
FIG. 9 is a flowchart showing processing of a head cleaning method.

FIG. 9 is a flowchart showing processing of a cleaning method of the head 32 by the ink jet recording device 10.

In Step S1, the ink jet heads 32C, 32M, 32Y, and 32K perform pressurization purging at the maintenance position toward the caps 52C, 52M, 52Y, and 52K (an example of a pressurization purging step). The pressurization purging is controlled by the pressurization purging controller 162 of the maintenance controller 160. The pressurization purging is performed in order to remove an ink of which viscosity inside the nozzles 202 has risen.

In a case where the pressurization purging is finished, the head movement controller 150 controls the head moving unit 36 to move the ink jet heads 32C, 32M, 32Y, and 32K from the maintenance position to the image recording position. Herein, the cleaning controller 154 moves the nozzle surface wiping unit 82 of the nozzle surface cleaning unit 80 in advance to the retracted position, and does not bring each of the nozzle surfaces 33 of the ink jet heads 32C, 32M, 32Y, and 32K into contact with the nozzle surface wiping devices 100C, 100M, 100Y, and 100K of the nozzle surface wiping unit 82.

In a case where the movement of the ink jet heads 32C, 32M, 32Y, and 32K is finished, the pressing force adjusting unit 158 of the cleaning controller 154 moves the nozzle surface wiping unit 82 to the wiping position in Step S2. A pressing force between the wiping web 104 and the nozzle surface 33 is adjusted by changing the position of the supporting stand 112 in the Z-direction and adjusting the distance h between the supporting stand 112 and the nozzle surface 33 in each of the nozzle surface wiping devices 100C, 100M, 100Y, and 100K (refer to FIG. 7).

Herein, a pressing force between the wiping web 104 of each of the nozzle surface wiping devices 100C, 100M, and 100Y and the nozzle surface 33 of each of the ink jet heads 32C, 32M, and 32Y (an example of a liquid jetting head jetting an ink other than a black ink) is set as a first pressing force. A distance at which the pressing force is the first pressing force is set as a distance $h_1$ (an example of a first distance). The pressing force adjusting unit 158 changes the position of the supporting stand 112 of each of the nozzle surface wiping devices 100C, 100M, and 100Y in the Z-direction, and sets a distance between the supporting stand 112 of each of the nozzle surface wiping devices 100C, 100M, and 100Y and the nozzle surface 33 of each of the ink jet heads 32C, 32M, and 32Y as the distance $h_1$.

In addition, the pressing force adjusting unit 158 sets a pressing force between the wiping web 104 of the nozzle surface wiping device 100K and the nozzle surface 33 of the ink jet head 32K (an example of a liquid jetting head that jets a black ink) as a third pressing force which is weaker than the first pressing force. Herein, a distance at which the pressing force is the third pressing force is set as a distance $h_3$ (an example of a third distance). The distance $h_3$ is larger than the distance $h_1$. The pressing force adjusting unit 158 changes a position of the supporting stand 112 of the nozzle surface wiping device 100K, and sets a distance between the supporting stand 112 of the nozzle surface wiping device 100K and the nozzle surface 33 of the ink jet head 32K as the distance $h_3$.

Next, the head movement controller 150 controls the head moving unit 36 to move the ink jet heads 32C, 32M, 32Y, and 32K from the image recording position to the maintenance position at a first speed in Step S3. Herein, the first speed is 5 mm/s (millimeters per second).

In Step S4, the cleaning controller 154 causes the web transporting unit 102 of each of the nozzle surface wiping devices 100C, 100M, 100Y, and 100K to transport the wiping web 104. Herein, the transported speed of the wiping web 104 is 3 mm/s. In addition, the cleaning controller 154 does not cause a cleaning liquid to be applied to the wiping web 104 (an example of non-operation), and lets the wiping web 104 stay in the dry state. Also in a case where the amount of a cleaning liquid applied to the wiping web 104 is less than 10% of the amount of a cleaning liquid that can be absorbed by the wiping web 104, the wiping web 104 can be considered to be in the dry state.

In this state, in a case where the ink jet heads 32C, 32M, 32Y, and 32K respectively reach positions facing the nozzle surface wiping devices 100C, 100M, 100Y, and 100K, each nozzle surface 33 is wiped by the wiping web 104. That is, the wiping web 104 in the dry state dry wipes each of the nozzle surfaces 33 of the ink jet heads 32C, 32M, and 32Y at the first pressing force, and the wiping web 104 in the dry state dry wipes the nozzle surface 33 of the ink jet head 32K at the third pressing force (an example of the first wiping mode and an example of a cleaning step).

Figure 10:
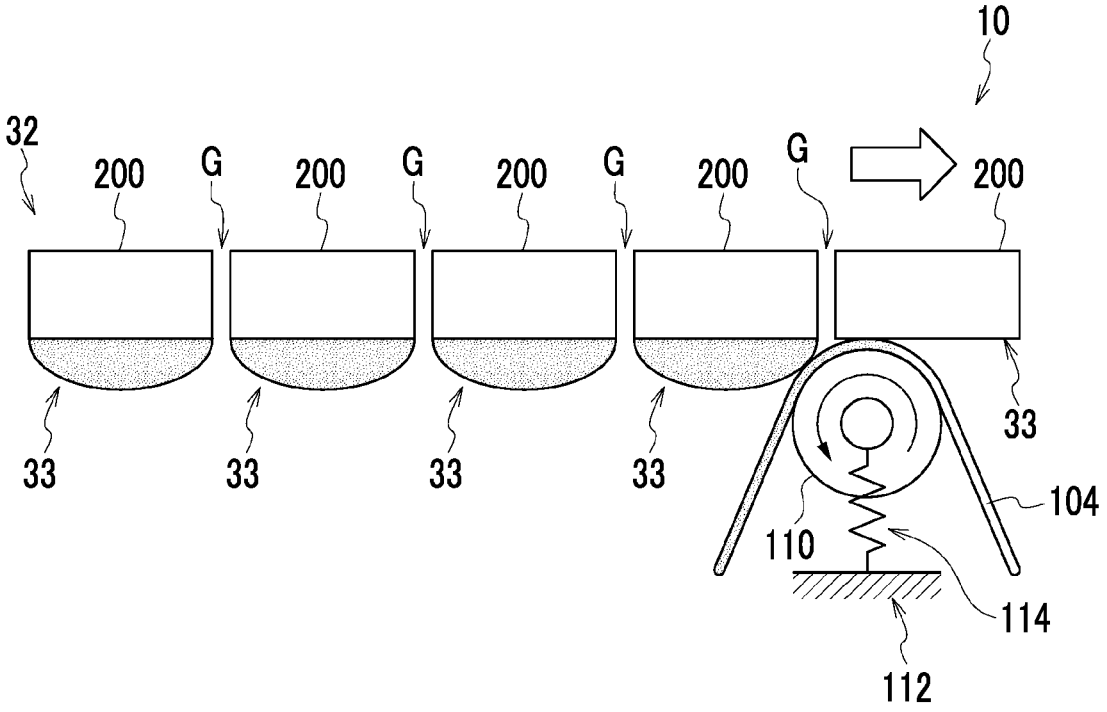
FIG. 10 is a schematic view illustrating dry wiping.

FIG. 10 is a schematic view illustrating dry wiping. In the pressurization purging of Step S1, a large amount of ink droplets remain on the nozzle surfaces 33 of the head 32. Therefore, wiping, in which the ink droplets are absorbed by the wiping web 104 in the dry state, is performed. It is important to ensure that the ink droplets do not infiltrate into the gaps G between the head modules 200 adjacent to each other.

It is sufficient that the wiping web 104 comes into contact with the ink droplets in order to absorb the ink droplets. For this reason, it is not necessary to apply a pressing force to the nozzle surfaces 33, in principle. In a case where a pressing force to the nozzle surfaces 33 is excessively high, the pressing force causes the ink absorbed by the wiping web 104 to be squeezed out, and the ink is pushed into the gaps G between the head modules 200. Therefore, it is necessary that the first pressing force and the third pressing force are pressing forces that do not squeeze out the ink absorbed by the wiping web 104.

In a case where the dry wiping is finished, the cleaning controller 154 moves the nozzle surface wiping unit 82 to the retracted position, and the head movement controller 150 moves the ink jet heads 32C, 32M. 32Y, and 32K from the maintenance position to the image recording position.

Next, in Step S5, the pressing force adjusting unit 158 of the cleaning controller 154 moves the nozzle surface wiping unit 82 to the wiping position, and adjusts the distance h between the supporting stand 112 and the nozzle surface 33 (refer to FIG. 7) in each of the nozzle surface wiping devices 100C, 100M, 100Y, and 100K. Herein, a pressing force between the wiping web 104 of each of the nozzle surface wiping devices 100C, 100M, 100Y, and 100K and the nozzle surface 33 of each of the ink jet heads 32C, 32M, 32Y, and 32K is set as a second pressing force which is larger than the first pressing force. Herein, a distance at which the pressing force is the second pressing force is set as a distance $h_2$ (an example of a second distance). The distance $h_2$ is smaller than the distance $h_1$. The pressing force adjusting unit 158 sets a distance between the supporting stand 112 of each of the nozzle surface wiping devices 100C, 100M, 100Y, and 100K and the nozzle surface 33 of each of the ink jet heads 32C, 32M, 32Y, and 32K as the distance $h_2$.

Next, the head movement controller 150 controls the head moving unit 36 to move the ink jet heads 32C, 32M, 32Y, and 32K from the image recording position to the maintenance position at a second speed which is higher than the first speed in Step S6. Herein, the second speed is 40 mm/s.

In Step S7, the cleaning controller 154 causes the web transporting unit 102 of each of the nozzle surface wiping devices 100C, 100M, 100Y, and 100K to transport the wiping web 104. Herein, the transported speed of the wiping web 104 is 3 mm/s.

In addition, the cleaning controller 154 controls the cleaning liquid applying unit 130 of each of the nozzle surface wiping devices 100C, 100M, 100Y, and 100K to apply a cleaning liquid to the wiping web 104, thereby bringing the wiping web 104 into the wet state.

Herein, an absorbing amount of the wiping web 104 per unit area is 0.2 mg/mm$^2$ (milligram per square millimeter), the transported speed of the wiping web 104 is 3 mm/s, the width of the wiping web 104 (a length in a direction orthogonal to the transporting direction) is 45 mm (millimeter), and the absorbing amount of the wiping web 104 is 0.2×3×45=27 mg/s (milligram per second).

The applied amount of a cleaning liquid by the cleaning liquid applying unit 130 is 50 mg/s. That is, an amount which is excessively larger than an amount that the wiping web 104 can absorb is applied. Without being limited to a state where an excessively larger amount of a cleaning liquid than the absorbable amount is applied, the wiping web 104 in the wet state may be in a state where a cleaning liquid is applied to an extent that dirt and mist adhered to the nozzle surfaces 33 can be removed.

In this state, in a case where the ink jet heads 32C, 32M, 32Y, and 32K respectively reach the positions facing the nozzle surface wiping devices 100C, 100M, 100Y, and 100K, each nozzle surface 33 is wiped by the wiping web 104. That is, the wiping web 104 in the wet state wet wipes each of the nozzle surfaces 33 of the ink jet heads 32C, 32M, 32Y, and 32K at the second pressing force (an example of the second wiping mode).

Figure 11:
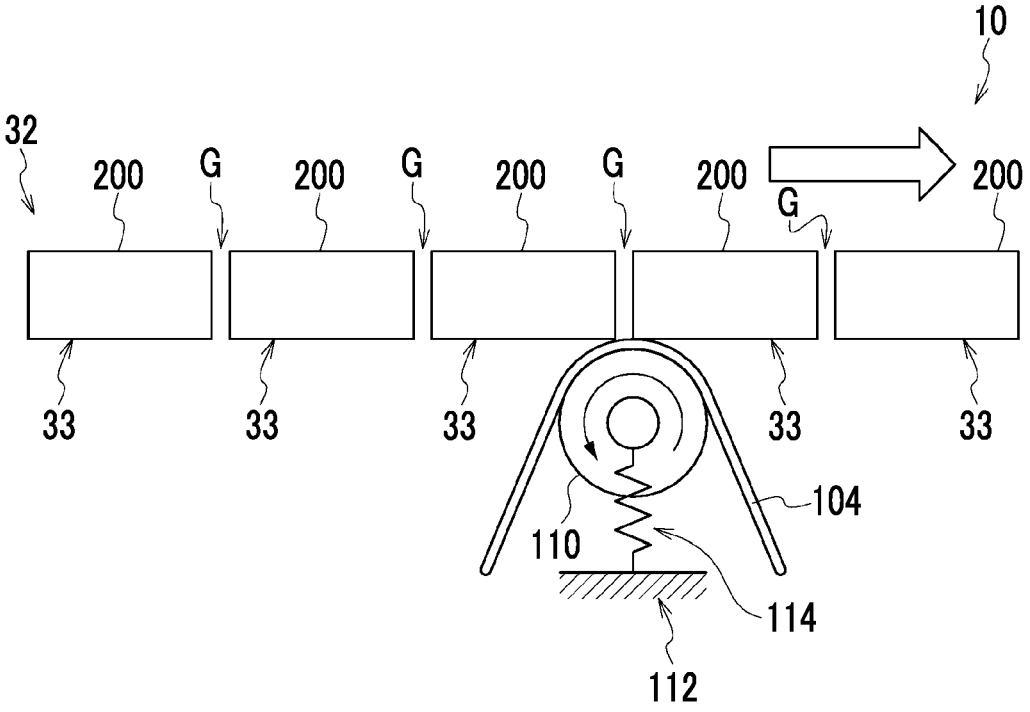
FIG. 11 is a schematic view illustrating wet wiping.

FIG. 11 is a schematic view illustrating wet wiping. Wet wiping is wiping of removing dirt on the nozzle surfaces 33 by the wiping web 104 in the wet state. In the dry wiping of Step S4, ink droplets do not remain on the nozzle surfaces 33 of the head 32. Therefore, ink droplets do not infiltrate into the gaps G between the head modules 200 adjacent to each other. For this reason, the nozzle surfaces 33 can be wiped at a relatively strong pressing force.

In the dry wiping of Step S4, the ink jet heads 32C, 32M, 32Y, and 32K are moved at the relatively low first speed in order for the wiping webs 104 to absorb ink droplets on the nozzle surfaces 33. On the contrary, in the wet wiping, the ink jet heads 32C, 32M, 32Y and 32K are moved at the relatively high second speed so that wiping is performed. Although the transported speeds of the wiping web 104 are the same in the dry wiping and the wet wiping the embodiment, it is also possible to make a transported speed in the dry wiping a relatively lower speed than a transported speed in the wet wiping depending on an absorbing performance of the wiping web 104.

In a case where the first wet wiping is finished, the cleaning controller 154 moves the nozzle surface wiping unit 82 to the retracted position, and the head movement controller 150 moves the ink jet heads 32C, 32M, 32Y, and 32K from the maintenance position to the image recording position.

Next, in Step S8, the pressing force adjusting unit 158 of the cleaning controller 154 moves the nozzle surface wiping unit 82 to the wiping position, adjusts the distance h between the supporting stand 112 and the nozzle surface 33 in each of the nozzle surface wiping devices 100C, 100M, 100Y, and 100K so as to become the distance $h_2$, and sets the pressing force between the wiping web 104 and the nozzle surface 33 to the second pressing force.

In addition, the head movement controller 150 controls the head moving unit 36 to move the ink jet heads 32C, 32M, 32Y, and 32K from the image recording position to the maintenance position at the second speed.

In Step S9, the cleaning controller 154 causes the web transporting unit 102 of each of the nozzle surface wiping devices 100C, 100M, 100Y, and 100K to transport the wiping web 104. Herein, the cleaning controller 154 applies a cleaning liquid to the wiping web 104, thereby bringing the wiping web 104 into the wet state.

In this state, in a case where the ink jet heads 32C, 32M, 32Y and 32K respectively reach the positions facing the nozzle surface wiping devices 100C, 100M, 100Y, and 100K, each of the nozzle surfaces 33 of the ink jet heads 32C, 32M, 32Y, and 32K is wiped by the wiping web 104. That is, the wiping web 104 in the wet state wet wipes each of the nozzle surfaces 33 at the second pressing force (an example of a third wiping mode).

With this, the cleaning of the ink jet heads 32C, 32M, 32Y, and 32K is finished.

Although a cleaning method immediately after the ink jet heads 32C, 32M, 32Y, and 32K perform pressurization purging at the maintenance position is described herein, the ink jet recording device 10 does not execute dry wiping but executes wet wiping immediately after the ink jet heads 32C, 32M, 32Y, and 32K have recorded an image on the sheet P at the image recording position, and immediately after the ink jet heads 32C, 32M, 32Y, and 32K have performed pre-jetting at the maintenance position.

That is, in a case of wiping off a large amount of liquid-like ink droplets remaining on the nozzle surfaces after pressurization purging, the ink jet recording device 10 selects the dry wiping mode. In a case of wiping off a small amount of solid-like ink mist which is adhered and dried on the nozzle surfaces due to printing, the ink jet recording device selects the wet wiping mode (an example of a selecting step). In a case where the amount of an ink remaining on the nozzle surfaces 33 of the ink jet heads 32C, 32M, 32Y, and 32K is relatively large, the ink jet recording device 10 may select the dry wiping mode. In a case where the amount of an ink remaining on the nozzle surfaces 33 is relatively small, the ink jet recording device may select the wet wiping mode.

<Evaluation on Wipeability and Infiltration of Ink into Gap>

Wipeability and infiltration of an ink into gaps are evaluated under the following conditions.

Wiping web material: Polyester

Ink: C-WP-QM (magenta) made by Fujifilm Corporation

Liquid jetting head: Samba made by Fujifilm Dimatix

Head configuration: One ink jet head is configured by connecting 17 modules, and a gap between the modules is 0.3 mm In addition, the classification of evaluation results is as follows.

A: Good

B: Somewhat problematic

C: Problematic

[Wipeability of Wet Wiping]

With the pressing force between the wiping web 104 and the nozzle surface 33 as a parameter, the nozzle surfaces 33 are wet wiped, and wipeability is evaluated based on the amount of mist remaining on the nozzle surfaces 33. The amount of mist on the nozzle surfaces 33 before wiping is 20,000 to 30,000 pieces/$mm^2$ (piece per square millimeter).

Evaluation results are shown in Table 1. The amount of remaining mist is measured by observing four places of the wiped nozzle surface 33, each of which having an area of 5 $mm^2$, through a microscope.

TABLE 1

| | 0 to 15 kPa | 16k to 19 kPa | 20k to 60 kPa |
|---|---|---|---|
| Evaluation results Amount of remaining mist | C 50 pieces/$mm^2$ or more | B 10 to 40 pieces/$mm^2$ | A 5 pieces/$mm^2$ or less |

As shown in Table 1, it is found that it is preferable to perform wet wiping at a pressing force from 20 k to 60 kPa inclusive (kilopascal).

[Wipeability of Dry Wiping and Infiltration of Ink into Gap]

With the pressing force between the wiping web 104 and the nozzle surface 33 as a parameter, the nozzle surfaces 33 after pressurization purging are dry wiped, and wipeability is evaluated based on a purged ink amount remaining on the nozzle surfaces 33. Evaluation results are shown in Table 2. The amount of a remaining ink is measured by causing an absorber for evaluation to absorb the ink on the wipe nozzle surfaces 33, and measuring the mass of the absorber for evaluation.

TABLE 2

| | 0 to 15 kPa | 16k to 19 kPa | 20k to 60 kPa |
|---|---|---|---|
| Evaluation results Amount of remaining ink | A 5 mg/module or less | A 5 mg/module or less | A 5 mg/module or less |

As shown in Table 2, in dry wiping after pressurization purging, the amount of a remaining ink is equal to or smaller than 5 mg (milligram) per module regardless of a pressing force, which is good.

As described above, gap ink infiltration is evaluated based on the amount of an ink that has entered the gap between the head modules 200. Evaluation results are shown in Table 3. The amount of an infiltrated ink is measured by causing the absorber for evaluation to absorb the ink infiltrated into the gaps after wiping, and measuring the mass of the absorber for evaluation.

TABLE 3

| | 0 to 15 kPa | 16k to 19 kPa | 20k to 60 kPa |
|---|---|---|---|
| Evaluation results Amount of infiltrated ink | A 2 mg/gap or less | B 4 to 8 mg/gap | C 10 mg/gap or more |

As shown in Table 3, in a case where the pressing force is strong, the amount of an infiltrated ink increases. It is found that it is preferable to perform dry wiping, which is after pressurization purging, at a pressing force of 0 to 15 kPa since the amount of an ink infiltrated into the gaps is small.

Herein, the pressing force being 0 kPa is defined as a state where the distance between the nozzle surface 33 and the wiping web 104 is 0 and the pressing force is 0 kPa. That is, it is a state where the nozzle surface 33 and the wiping web 104 are in contact with each other but a pressure is not applied.

<Evaluation on Liquid Repellent Film Degradation>

Degradation of the liquid repellent film of the nozzle surface 33 is evaluated under the following conditions.

Wiping web material: Polyester

Ink: Made by Fujifilm Corporation, cyan: C-WP-QC, magenta: C-WP-QM, yellow: C-WP-QY, and black: C-WP-QK Liquid jetting head: A plate made of the same material as a nozzle surface for Samba made by Fujifilm Dimatix Under the conditions, a state where dry wiping is performed is simulated in a state where the nozzle surfaces 33 are wet with an ink due to pressurization purging by the wiping web 104, which is in the wet state by absorbing each color of ink, wiping each of the nozzle surfaces 33. The number of times of wiping until the contact angle declines to 60°, which is a yardstick of the life of the head, is measured. Evaluation results are shown in Table 4.

TABLE 4

| | 10 kPa | 15 kPa | 28 kPa | 38 kPa |
|---|---|---|---|---|
| Black | 13,000 times | 10,000 times | 7,000 times | 6,000 times |
| Cyan, magenta, and yellow | 200,000 times or more | 200,000 times or more | 200,000 times or more | 200,000 times or more |

As shown in Table 4, in cyan, magenta, and yellow inks, there is no dependence on the pressing force, and degradation of the liquid repellent film is not observed through 200,000 times or more of wiping.

On the contrary, in a black ink, it is found that the number of times of wiping until the contact angle declines to 60°, which is the yardstick of the life of the head, is larger in a case of a low pressing force. That is, a lower pressing force prolongs the life of the liquid repellent film in a case where wiping is repeated at the same frequency. That is because a pigment included in the black ink has a wearing effect.

As shown in Table 4, it is preferable that the pressing force of the wiping web 104 in a case of dry wiping the nozzle surfaces 33 of the ink jet head 32K is 15 kPa or less, and it is more preferable that the pressing force is 10 kPa or less. It is regarded that a liquid repellent film degradation reducing effect increases as the pressing force becomes closer to 0.

From the results described above, it is found that it is preferable to set the first pressing force, which is a pressing force between the wiping web 104 in the dry state of each of the nozzle surface wiping devices 100C, 100M, and 100Y and the nozzle surface 33 of each of the ink jet heads 32C, 32M, and 32Y to 0 to 15 kPa. That is, in dry wiping, the pressing force of 0 to 15 kPa is in a range that can prevent infiltration of an ink between the head modules and is desirable for appropriately wiping the nozzle surfaces.

In addition, it is found that it is preferable to set the second pressing force, which is a pressing force between the wiping web 104 in the wet state of each of the nozzle surface wiping devices 100C, 100M, 100Y, and 100K and the nozzle surface 33 of each of the ink jet heads 32C, 32M, 32Y, and 32K to 20 k to 60 kPa. That is, in wet wiping, the pressing force of 20 k to 60 kPa is in a range that can remove dried and fixed ink mist generated due to printing and is desirable for suppressing the wear of the liquid repellent film.

It is found that it is preferable to set the third pressing force, which is a pressing force between the wiping web 104 in the dry state of the nozzle surface wiping device 100K and the nozzle surface 33 of the ink jet head 32K to 0 to 10 kPa. That is, in the dry wiping of the ink jet head 32K that jets the black ink, the pressing force of 0 to 10 kPa is in a range that is desirable to suppress the wear of the liquid repellent film. It is preferable that the third pressing force is a pressing force smaller than the first pressing force.

<Another Form of Nozzle Surface Cleaning Unit>

Figure 12:
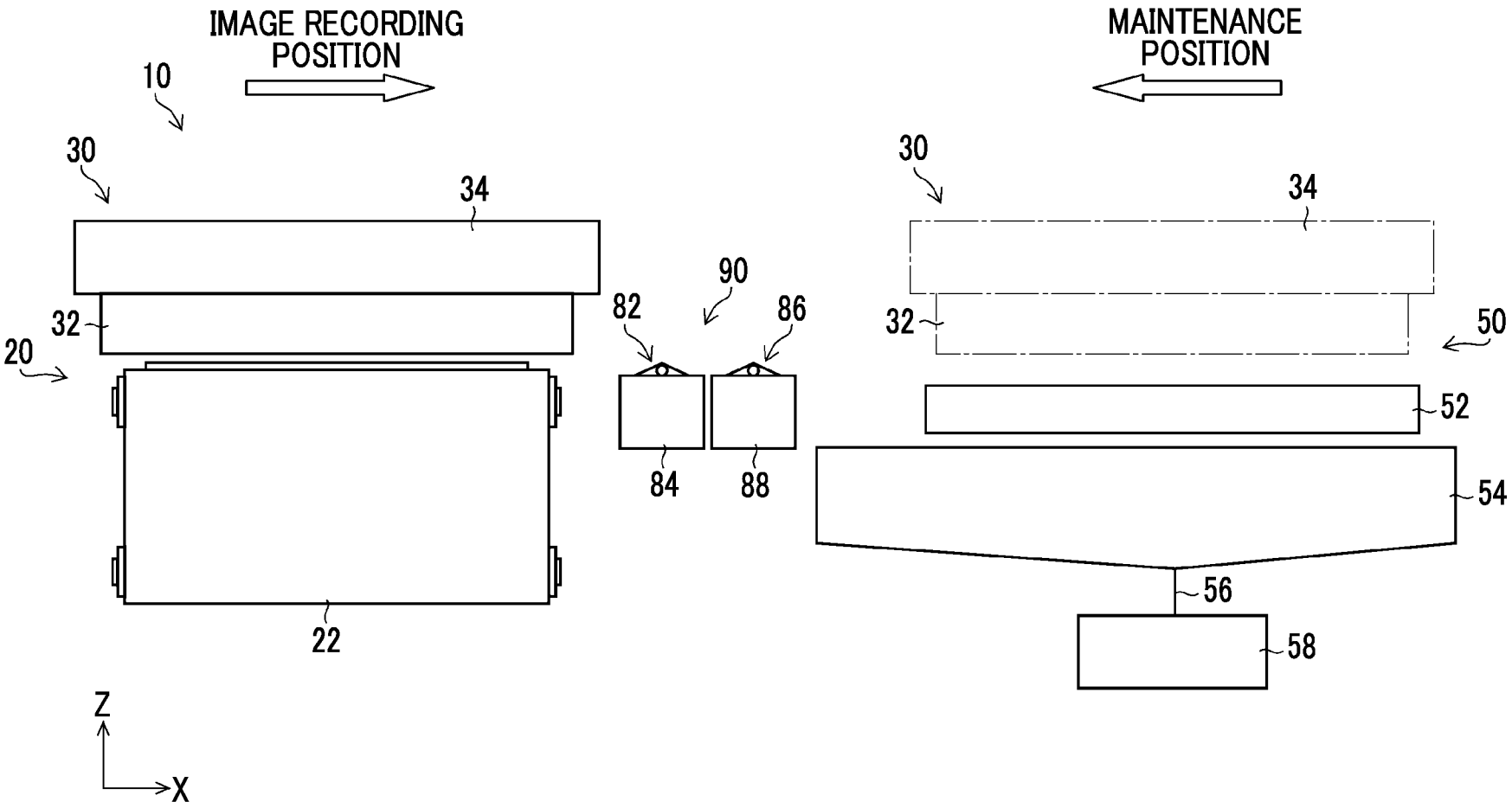
FIG. 12 is a front view of the ink jet recording device.

FIG. 12 is a front view illustrating a configuration of important parts of the ink jet recording device 10 comprising a nozzle surface cleaning unit 90. The nozzle surface cleaning unit 90 comprises the nozzle surface wiping unit 82 and a nozzle surface wiping unit 86.

The nozzle surface wiping unit 82 and the nozzle surface wiping unit 86 are disposed so as to be arranged in a moving direction of each of the ink jet heads 32C, 32M, 32Y, and 32K (the X-direction). The nozzle surface wiping unit 82 may be disposed on a maintenance position side, and the nozzle surface wiping unit 86 may be disposed on an image recording position side. In a case where the ink jet heads 32C, 32M, 32Y, and 32K move between the image recording position and the maintenance position, the nozzle surface wiping unit 82 and the nozzle surface wiping unit 86 wipe each of the nozzle surfaces 33.

The nozzle surface wiping unit 86 comprises nozzle surface wiping devices 100C, 100M, 100Y, and 100K that individually wipe the nozzle surfaces 33 of the ink jet heads 32C, 32M, 32Y, and 32K included in the head unit 30. The nozzle surface wiping devices 100C, 100M, 100Y, and 100K are provided on a common stand 88 in accordance with provision intervals between the ink jet heads 32C, 32M, 32Y, and 32K respectively. A configuration of each of the nozzle surface wiping devices 100C, 100M, 100Y, and 100K of the nozzle surface wiping unit 86 is the same as the nozzle surface wiping device 100 illustrated in FIG. 7.

Herein, the nozzle surface wiping devices 100C, 100M, 100Y, and 100K of the nozzle surface wiping unit 82 (an example of a dry wiping unit) wipe the nozzle surfaces 33 of the ink jet heads 32C, 32M, 32Y, and 32K in the dry wiping mode. That is, as the cleaning liquid applying unit 130 stops applying a cleaning liquid, the nozzle surface wiping devices 100C, 100M, 100Y, and 100K of the nozzle surface wiping unit 82 each bring the wiping web 104 that abuts against the nozzle surface 33 into the dry state.

On the contrary, the nozzle surface wiping devices 100C, 100M, 100Y, and 100K of the nozzle surface wiping unit 86 (an example of a wet wiping unit) wipe the nozzle surfaces 33 of the ink jet heads 32C, 32M, 32Y, and 32K in the wet wiping mode. That is, the nozzle surface wiping devices 100C, 100M, 100Y, and 100K of the nozzle surface wiping unit 86 each bring the wiping web 104 that abuts against the nozzle surface 33 into the wet state by means of the cleaning liquid applying unit 130.

As the nozzle surface wiping unit 82, the nozzle surface wiping unit 86 is configured to be movable by a moving mechanism (not illustrated) between the wiping position where each of the nozzle surfaces 33 is wiped and the retracted position where each of the nozzle surfaces 33 is not wiped in a case where the ink jet heads 32C, 32M, 32Y, and 32K are moved to a position of facing the nozzle surface wiping unit 86.

In the dry wiping mode, the nozzle surface wiping unit 82 moves to the wiping position, and the nozzle surface wiping unit 86 moves to the retracted position. On the contrary, in the wet wiping mode, the nozzle surface wiping unit 82 moves to the retracted position, and the nozzle surface wiping unit 86 moves to the wiping position. By moving in this manner, the nozzle surfaces 33 of the ink jet heads 32C, 32M, 32Y, and 32K can be dry wiped or wet wiped.

The nozzle surface wiping unit 82 may be used in wet wiping, or the nozzle surface wiping unit 86 may be used in dry wiping.

<Others>

It is possible to configure the cleaning method as a program for causing a computer to realize each step, and it is also possible to configure the cleaning method as a non-temporary recording medium in which the program is stored, such as a compact disk-read only memory (CD-ROM).

In the embodiment described hereinbefore, hardware structures of processing units that execute various types of processing, for example, the head movement controller 150, the image recording controller 152, the cleaning controller 154, and the maintenance controller 160, are various types of processors as follows. The various types of processors include a central processing unit (CPU) which is a general-purpose processor that executes software (program) to function as the various types of processing units, a programmable logic device (PLD) which is a processor having a circuit configuration that is changeable after manufacturing, such as a field programmable gate array (FPGA), and a dedicated electrical circuit which is a processor having a circuit configuration exclusively designed for executing certain processing, such as an application specific integrated circuit (ASIC).

One processing unit may be configured by one of the various types of processors, or may be configured by the same type or different types of two or more processors (for example, a plurality of FPGAs, or a combination of a CPU and a FPGA). In addition, a plurality of processing units may be configured by one processor. As an example of configuring the plurality of processing units by one processor, firstly, there is a form in which one processor is configured by a combination of one or more CPUs and software so as to be represented by a computer such as a server and a client and the processor functions as the plurality of processing units. Secondly, there is a form in which a processor that realizes a function of the entire system, including the plurality of processing units, with one integrated circuit (IC) chip is used so as to be represented by a system on chip (SoC). As described above, the various types of processing units are configured by using one or more of the various types of processors as the hardware structures.

More specifically, hardware structures of the various types of processors are electrical circuits (circuitry) obtained by combining circuit elements such as a semiconductor element.

The technical scope of the present invention is not limited to the scope described in the embodiment. Configurations of the respective embodiments can be combined between the respective embodiments as appropriate without departing from the gist of the present invention.

EXPLANATION OF REFERENCES

10: ink jet recording device
20: sheet transporting unit
22: belt
30: head unit
32: head
32C: ink jet head
32K: ink jet head
32M: ink jet head
32Y: ink jet head
33: nozzle surface
34: head supporting frame
36: head moving unit
50: maintenance unit
52: cap
52C: cap
52K: cap
52M: cap
52Y: cap
54: waste liquid tray
56: waste liquid collecting piping
58: waste liquid tank
80: nozzle surface cleaning unit
82: nozzle surface wiping unit
84: stand
86: nozzle surface wiping unit
88: stand
90: nozzle surface cleaning unit
100: nozzle surface wiping device
100C: nozzle surface wiping device
100K: nozzle surface wiping device
100M: nozzle surface wiping device
100Y: nozzle surface wiping device
102: web transporting unit
104: wiping web
106: supply shaft
108: winding shaft
110: press roller
112: supporting stand
114: spring
116: first guide roller
118: second guide roller
120: winding motor
130: cleaning liquid applying unit
132: cleaning liquid supplying nozzle
134: cleaning liquid tank
136: cleaning liquid flow passage
138: cleaning liquid pump
150: head movement controller
152: image recording controller
154: cleaning controller
156: selecting unit
158: pressing force adjusting unit
160: maintenance controller
162: pressurization purging controller
200: head module
200-1: head module
200-($i$−1): head module
200-$i$: head module
200-($i$+1): head module
200-$n$: head module
202: nozzle
G: gap
P: sheet
S1 to S9: steps of processing of liquid jetting head cleaning method

What is claimed is:

1. A liquid jetting head cleaning device comprising:

a pressurization purging controller that performs pressurization purging for pressurizing an inside of a liquid jetting head, which jets a liquid from a nozzle disposed on a nozzle surface, is formed by a plurality of head modules, and has a gap between the head modules adjacent to each other, to discharge the liquid from the nozzle; and a cleaning unit that has a first wiping mode in which a long wiping web in a dry state abuts against the nozzle surface of the liquid jetting head at a pressing force of 0 kPa or more and 15 kPa or less after the pressurization purging is performed, and the wiping web is transported with respect to the liquid jetting head in a web transporting direction to wipe the nozzle surface, wherein a plurality of the liquid jetting heads that jet inks having colors different from each other are provided, and in the first wiping mode, the cleaning unit sets a pressing force in a case of wiping the liquid jetting head that jets a black ink to a pressing force smaller than a pressing force in a case of wiping the liquid jetting head that jets an ink other than the black ink.

2. The liquid jetting head cleaning device according to claim 1, wherein the cleaning unit has a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface.

3. The liquid jetting head cleaning device according to claim 2, wherein the cleaning unit comprises a dry wiping unit that causes the wiping web in the dry state to abut against the nozzle surface of the liquid jetting head via an abutting member at a pressing force of 0 kPa or more and 15 kPa or less, and moves the abutting member relative to the liquid jetting head to wipe the nozzle surface, a wet wiping unit that causes the wiping web in the wet state to abut against the nozzle surface of the liquid jetting head via the abutting member at a pressing force of 20 kPa or more and 60 kPa or less, and moves the abutting member relative to the liquid jetting head to wipe the nozzle surface, and a cleaning controller that causes the dry wiping unit to wipe the nozzle surface in the first wiping mode, and causes the wet wiping unit to wipe the nozzle surface in the second wiping mode.

4. The liquid jetting head cleaning device according to claim 2, wherein the cleaning unit comprises a wiping unit that causes the wiping web to abut against the nozzle surface of the liquid jetting head via an abutting member, and moves the abutting member relative to the liquid jetting head to wipe the nozzle surface, a pressing force adjusting unit that adjusts a pressing force between the nozzle surface and the wiping web, a cleaning liquid applying unit that applies the cleaning liquid to the wiping web in the dry state to bring the wiping web into the wet state, and a cleaning controller that causes the cleaning liquid applying unit not to operate and causes the wiping web in the dry state to abut against the nozzle surface at a pressing force of 0 kPa or more and 15 kPa or less in the first wiping mode, and causes the cleaning liquid applying unit to apply the cleaning liquid and causes the wiping web in the wet state to abut against the nozzle surface at a pressing force of 20 kPa or more and 60 kPa or less in the second wiping mode.

5. The liquid jetting head cleaning device according to claim 4, wherein the cleaning unit comprises an elastic member that causes the abutting member to be biased in a first direction facing the nozzle surface, and a supporting unit that supports the elastic member, and the cleaning controller sets a distance between the supporting unit and the nozzle surface in the first direction to a first distance at which the pressing force between the nozzle surface and the wiping web is a pressing force of 0 kPa or more and 15 kPa or less in the first wiping mode, and sets the distance between the supporting unit and the nozzle surface in the first direction to a second distance at which the pressing force between the nozzle surface and the wiping web is a pressing force of 20 kPa or more and 60 kPa or less in the second wiping mode.

6. The liquid jetting head cleaning device according to claim 2, wherein the cleaning unit performs wiping in the second wiping mode for a first time after wiping in the first wiping mode, and performs wiping in the second wiping mode for a second time after wiping in the second wiping mode for the first time.

7. A liquid jetting head cleaning device comprising:

a cleaning unit that has a first wiping mode in which a long wiping web in a dry state abuts against a nozzle surface of a liquid jetting head, which jets a liquid from a nozzle disposed on the nozzle surface, is formed by a plurality of head modules, and has a gap between the head modules adjacent to each other, at a pressing force of 0 kPa or more and 15 kPa or less and the wiping web is transported with respect to the liquid jetting head in a web transporting direction to wipe the nozzle surface and a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface; and a selecting unit that selects one mode of the first wiping mode and the second wiping mode, wherein a plurality of the liquid jetting heads that jet inks having colors different from each other are provided, and in the first wiping mode, the cleaning unit sets a pressing force in a case of wiping the liquid jetting head that jets a black ink to a pressing force smaller than a pressing force in a case of wiping the liquid jetting head that jets an ink other than the black ink.

8. A liquid jetting device comprising:

a liquid jetting head that jets a liquid from a nozzle disposed on a nozzle surface, is formed by a plurality of head modules, and has a gap between the head modules adjacent to each other;

a transporting unit that transports a recording medium;

a recording controller that causes the liquid to be jetted from the nozzle of the liquid jetting head to the transported recording medium to record an image on the recording medium;

a pressurization purging controller that performs pressurization purging for pressurizing an inside of the liquid jetting head to discharge the liquid from the nozzle; and a cleaning unit that has a first wiping mode in which a long wiping web in a dry state abuts against the nozzle surface of the liquid jetting head at a pressing force of 0 kPa or more and 15 kPa or less after the pressurization purging is performed, and the wiping web is transported with respect to the liquid jetting head in a web transporting direction to wipe the nozzle surface, wherein a plurality of the liquid jetting heads that jet inks having colors different from each other are provided, and in the first wiping mode, the cleaning unit sets a pressing force in a case of wiping the liquid jetting head that jets a black ink to a pressing force smaller than a pressing force in a case of wiping the liquid jetting head that jets an ink other than the black ink.

9. A liquid jetting head cleaning method comprising:

a pressurization purging step of performing pressurization purging for pressurizing an inside of a liquid jetting head, which jets a liquid from a nozzle disposed on a nozzle surface, is formed by a plurality of head modules, and has a gap between the head modules adjacent to each other, to discharge the liquid from the nozzle; and a cleaning step of causing a long wiping web in a dry state to abut against the nozzle surface of the liquid jetting head at a pressing force of 0 kPa or more and 15 kPa or less after the pressurization purging is performed, and wiping the nozzle surface by transporting the wiping web with respect to the liquid jetting head in a web transporting direction according to a first wiping mode, wherein a plurality of the liquid jetting heads that jet inks having colors different from each other are provided, and in the first wiping mode, a pressing force in a case of wiping the liquid jetting head that jets a black ink is set to a pressing force smaller than a pressing force in a case of wiping the liquid jetting head that jets an ink other than the black ink.

10. A liquid jetting head cleaning method comprising:

a cleaning step that has a first wiping mode in which a long wiping web in a dry state abuts against a nozzle surface of a liquid jetting head, which jets a liquid from a nozzle disposed on the nozzle surface, is formed by a plurality of head modules, and has a gap between the head modules adjacent to each other, at a pressing force of 0 kPa or more and 15 kPa or less and the wiping web is transported with respect to the liquid jetting head in a web transporting direction to wipe the nozzle surface and a second wiping mode in which the long wiping web that is in a wet state due to a cleaning liquid abuts against the nozzle surface of the liquid jetting head at a pressing force of 20 kPa or more and 60 kPa or less and the wiping web is transported with respect to the liquid jetting head in the web transporting direction to wipe the nozzle surface; and a selecting step of selecting one mode of the first wiping mode and the second wiping mode, wherein a plurality of the liquid jetting heads that jet inks having colors different from each other are provided, and in the first wiping mode, a pressing force in a case of wiping the liquid jetting head that jets a black ink is set to a pressing force smaller than a pressing force in a case of wiping the liquid jetting head that jets an ink other than the black ink.

* * * * *